US009899737B2

(12) United States Patent
Haridas et al.

(10) Patent No.: US 9,899,737 B2
(45) Date of Patent: Feb. 20, 2018

(54) ANTENNA ELEMENT AND ANTENNA DEVICE COMPRISING SUCH ELEMENTS

(71) Applicant: SOFANT TECHNOLOGIES LTD, Edinburgh (GB)

(72) Inventors: Nakul Raghavanand Haridas, Edinburgh (GB); Ahmed Osman El-Rayis, Lothian (GB); Tughrul Sati Arslan, Lothian (GB)

(73) Assignee: SOFANT TECHNOLOGIES LTD, Edinburgh (GB)

( * ) Notice: Subject to any disclaimer, the term of this patent is extended or adjusted under 35 U.S.C. 154(b) by 154 days.

(21) Appl. No.: 14/368,029

(22) PCT Filed: Dec. 19, 2012

(86) PCT No.: PCT/GB2012/053196
§ 371 (c)(1),
(2) Date: Jun. 23, 2014

(87) PCT Pub. No.: WO2013/093466
PCT Pub. Date: Jun. 27, 2013

(65) Prior Publication Data

US 2014/0361947 A1 Dec. 11, 2014

(30) Foreign Application Priority Data

Dec. 23, 2011 (GB) ..... 1122324.5

(51) Int. Cl.
*H01Q 9/04* (2006.01)
*H01Q 1/24* (2006.01)
(Continued)

(52) U.S. Cl.
CPC ..... *H01Q 9/0407* (2013.01); *H01Q 1/243* (2013.01); *H01Q 1/48* (2013.01); *H01Q 5/371* (2015.01);
(Continued)

(58) Field of Classification Search
CPC ..... H01Q 9/407; H01Q 1/48
(Continued)

(56) References Cited

U.S. PATENT DOCUMENTS 2,429,726 A 10/1947 Lewis
2,524,993 A 10/1950 Rumsey
(Continued)

FOREIGN PATENT DOCUMENTS

DE 199 83 824 3/2002
DE 69 720 484 2/2004
(Continued)

OTHER PUBLICATIONS

International Search Report (3 Pages) Dated May 5, 2013, Issued in Corresponding EP Application No. PCT/GB2012/053196.
(Continued)

*Primary Examiner* — Dameon E Levi
*Assistant Examiner* — Walter Davis
(74) *Attorney, Agent, or Firm* — Nixon & Vanderhye P.C.

(57) ABSTRACT

An antenna element (100) comprises an active patch formed by a conductive layer (104) on a front surface of a substrate (102) and a parasitic ground patch (106) on a back surface of the substrate. The active patch has a spiral slot (112) in a central portion, and peripheral portions (110*a*-110*d*) which are substantially wider than the spiral slot. A signal feed strip (114) extends from a side of said active patch across the front surface of the substrate. Two signal ground strips (116, 118) are provided on the front surface, each separated from the active patch by a predetermined gap (120, 122). The parasitic ground patch has a slot in a central portion substantially back-to-back with the central portion of the active patch through the substrate. The element has broadband properties that can be tuned by various modifications. Sev-
(Continued)

eral elements can be used in close array, with lower cross-talk than known antenna designs.

17 Claims, 20 Drawing Sheets

(51) Int. Cl.
*H01Q 1/48* (2006.01)
*H01Q 9/40* (2006.01)
*H01Q 5/371* (2015.01)

(52) U.S. Cl.
CPC ..... *H01Q 9/045* (2013.01); *H01Q 9/0442* (2013.01); *H01Q 9/40* (2013.01)

(58) Field of Classification Search
USPC ..... 343/848
See application file for complete search history.

(56) References Cited

U.S. PATENT DOCUMENTS 2,765,731 A 10/1956 Edwards
2,838,754 A 6/1958 Bickmore
3,380,052 A 4/1968 Drabowitch et al.
3,441,937 A 4/1969 Clasby et al.
3,448,455 A 6/1969 Alfandari et al.
3,449,751 A 6/1969 Schroeder
5,038,146 A 8/1991 Troychak et al.
5,135,341 A 8/1992 Leyder
5,892,482 A 4/1999 Coleman, Jr. et al.
5,963,871 A 10/1999 Zhinong et al.
6,112,102 A 8/2000 Zhinong
6,166,694 A 12/2000 Ying
6,181,279 B1 1/2001 Van Hoozen
6,218,989 B1 4/2001 Schneider et al.
6,285,342 B1 9/2001 Brady et al.
6,295,029 B1 9/2001 Chen et al.
6,297,774 B1 10/2001 Chung
6,326,921 B1 12/2001 Egorov et al.
6,329,962 B2 12/2001 Ying
6,343,208 B1 1/2002 Ying
6,353,443 B1 3/2002 Ying
6,408,190 B1 6/2002 Ying
6,424,315 B1 7/2002 Glenn et al.
6,442,400 B1 8/2002 Ying et al.
6,456,250 B1 9/2002 Ying et al.
6,501,426 B2 12/2002 Waterman
6,542,122 B1 4/2003 Bolin et al.
6,650,294 B2 11/2003 Ying et al.
6,653,978 B2 11/2003 Lahti
6,697,020 B2 2/2004 Ying
6,791,497 B2 * 9/2004 Winebrand ..... H01Q 1/38 343/702
6,795,023 B2 9/2004 Chen
6,906,669 B2 * 6/2005 Sabet ..... H01Q 1/36 343/700 MS
6,930,640 B2 * 8/2005 Chung ..... H01Q 1/38 343/700 MS
6,937,206 B2 8/2005 Puente Baliarda et al.
6,950,065 B2 9/2005 Ying et al.
6,975,269 B2 12/2005 Jecko et al.
6,995,715 B2 2/2006 Ying et al.
7,068,227 B2 6/2006 Ying
7,095,372 B2 8/2006 Soler Castany et al.
7,126,547 B2 10/2006 Kim et al.
7,148,850 B2 12/2006 Puente Baliarda et al.
7,202,818 B2 4/2007 Anguera Pros et al.
7,202,822 B2 4/2007 Baliarda et al.
7,315,289 B2 1/2008 Puente Baliarda et al.
7,362,283 B2 4/2008 Quintero Illera et al.
7,397,431 B2 7/2008 Baliarda et al.
7,453,402 B2 11/2008 Rowell et al.
7,453,404 B2 11/2008 Ying
7,463,199 B2 12/2008 Soler Castany et al.
7,471,246 B2 12/2008 Soler Castany et al.
7,554,490 B2 6/2009 Baliarda et al.
7,639,187 B2 12/2009 Cabellero et al.
7,688,276 B2 3/2010 Quintero Illera et al.
7,903,034 B2 3/2011 Anguera et al.
7,903,037 B2 3/2011 Gala Gala et al.
7,907,092 B2 3/2011 Soler Castany et al.
7,911,394 B2 3/2011 Quintero Illera et al.
7,920,097 B2 4/2011 Quintero Illera et al.
7,924,226 B2 4/2011 Soler Castany et al.
7,928,915 B2 4/2011 Sanz Arronte et al.
7,932,870 B2 4/2011 Baliarda et al.
7,999,748 B2 8/2011 Ligtenberg et al.
2002/0135521 A1 9/2002 Moore
2002/0163469 A1 11/2002 Waterman
2003/0184476 A1 10/2003 Sikina et al.
2003/0193439 A1 10/2003 Park
2003/0210192 A1 11/2003 Chen
2003/0210199 A1 11/2003 Sward et al.
2004/0056812 A1 3/2004 Sabet et al.
2004/0080457 A1 4/2004 Guo et al.
2004/0189529 A1 9/2004 Jecko et al.
2004/0217916 A1 11/2004 Quintero Illera et al.
2004/0233109 A1 11/2004 Ying et al.
2004/0245548 A1 12/2004 Stockmeier et al.
2005/0024271 A1 2/2005 Ying et al.
2005/0110688 A1 5/2005 Baliarda et al.
2005/0190106 A1 10/2005 Anguera Pros et al.
2005/0219144 A1 10/2005 Ying
2005/0231434 A1 10/2005 Azadegan et al.
2006/0033664 A1 2/2006 Soler Castany et al.
2006/0038724 A1 2/2006 Tikhov et al.
2006/0139211 A1 6/2006 Vance et al.
2007/0046548 A1 3/2007 Pros et al.
2007/0080871 A1 4/2007 Ying
2007/0153512 A1 7/2007 Hendrie
2007/0279292 A1 12/2007 Shih
2007/0290927 A1 12/2007 Rowell et al.
2008/0062049 A1 3/2008 Soler Castany et al.
2008/0129630 A1 6/2008 Baliarda et al.
2008/0158069 A1 7/2008 Mateus Mendes et al.
2008/0169982 A1 7/2008 Mei
2008/0198082 A1 8/2008 Soler Castany et al.
2008/0252536 A1 10/2008 Anguera et al.
2009/0033583 A1 2/2009 Ryou et al.
2009/0085810 A1 4/2009 Soler Castany et al.
2009/0153410 A1 * 6/2009 Chiang ..... H01Q 13/08 343/702
2009/0201211 A1 * 8/2009 Saily ..... H01Q 1/243 343/702
2009/0224995 A1 9/2009 Puente et al.
2009/0262028 A1 10/2009 Mumbru et al.
2010/0164828 A1 7/2010 Huang
2010/0171675 A1 7/2010 Borja et al.
2010/0207832 A1 8/2010 Ying et al.
2011/0134010 A1 * 6/2011 Toyao ..... H01P 1/2005 343/844
2011/0175776 A1 7/2011 Anguera et al.

FOREIGN PATENT DOCUMENTS

DE 602 05 720 5/2006
DE 602 11 889 6/2007
DE 600 33 140 10/2007
DE 603 18 199 12/2008
EP 0 720 252 7/1996
EP 1 085 599 3/2001
EP 1 093 677 4/2001
EP 1 095 422 5/2001
EP 1 095 423 5/2001
EP 1 152 487 11/2001
EP 1 168 491 1/2002
EP 1 256 999 11/2002
EP 0 929 912 4/2003
EP 1 443 595 8/2004
EP 1 471 596 10/2004
EP 1 215 751 4/2005
EP 1 361 623 8/2005
EP 1 564 842 8/2005

(56) References Cited

FOREIGN PATENT DOCUMENTS

| | | |
|---|---|---|
| EP | 1 569 298 | 8/2005 |
| EP | 1 451 899 | 8/2007 |
| EP | 1 305 846 | 9/2007 |
| EP | 1 834 378 | 9/2007 |
| EP | 1 506 594 | 12/2007 |
| EP | 1 436 857 | 1/2008 |
| EP | 1 649 542 | 9/2008 |
| EP | 1 569 298 | 4/2009 |
| EP | 2 133 955 | 12/2009 |
| EP | 2 207 238 | 7/2010 |
| EP | 2 230 723 | 9/2010 |
| EP | 2 323 219 | 5/2011 |
| FR | 1 419 597 | 12/1965 |
| FR | 2 835 972 | 8/2003 |
| GB | 2 373 637 | 9/2002 |
| GB | 2 363 911 | 11/2003 |
| JP | 09-148836 | 6/1997 |
| JP | 2001-203525 | 7/2001 |
| JP | 3265953 | 1/2002 |
| JP | 2004-260319 | 9/2004 |
| JP | 2006-504328 | 2/2006 |
| JP | 2007-245522 | 9/2007 |
| JP | 4008703 | 11/2007 |
| JP | 2008-505501 | 2/2008 |
| JP | 2008-205711 | 9/2008 |
| JP | 2011-055027 | 3/2011 |
| KR | 10-2011-0031614 | 3/2011 |
| WO | WO 98/15028 | 4/1998 |
| WO | WO 98/15029 | 4/1998 |
| WO | WO 99/25043 | 5/1999 |
| WO | WO 99/59221 | 11/1999 |
| WO | WO 00/03452 | 1/2000 |
| WO | WO 00/03453 | 1/2000 |
| WO | WO 00/36700 | 6/2000 |
| WO | WO 01/17063 | 3/2001 |
| WO | WO 01/91233 | 11/2001 |
| WO | WO 02/13307 | 2/2002 |
| WO | WO 02/25770 | 3/2002 |
| WO | WO 02/29928 | 4/2002 |
| WO | WO 02/078124 | 10/2002 |
| WO | WO 03/034545 | 4/2003 |
| WO | WO 03/047031 | 6/2003 |
| WO | WO 03/094293 | 11/2003 |
| WO | WO 03/096474 | 11/2003 |
| WO | WO 03/096477 | 11/2003 |
| WO | WO 2004/025778 | 3/2004 |
| WO | WO 2004/042868 | 5/2004 |
| WO | WO 2004066439 | 8/2004 |
| WO | WO 2004/097977 | 11/2004 |
| WO | WO 2004/102734 | 11/2004 |
| WO | WO 2005/015682 | 2/2005 |
| WO | WO 2005/081361 | 9/2005 |
| WO | WO 2006/034940 | 4/2006 |
| WO | WO 2006/071270 | 7/2006 |
| WO | WO 2006/120250 | 11/2006 |
| WO | WO 2007/000749 | 1/2007 |
| WO | WO 2007/028448 | 3/2007 |
| WO | WO 2007/040327 | 4/2007 |
| WO | WO 2007/128340 | 11/2007 |
| WO | WO 2007/141187 | 12/2007 |
| WO | WO 2008/000175 | 1/2008 |
| WO | WO 2008/076543 | 6/2008 |
| WO | WO 2008/148569 | 12/2008 |
| WO | WO 2009/004128 | 1/2009 |
| WO | WO 2009/023551 | 2/2009 |
| WO | WO 2010/094348 | 8/2010 |
| WO | WO 2011/073802 | 6/2011 |
| WO | WO 2011/102143 | 8/2011 |

OTHER PUBLICATIONS

Wikipedia Article on Dipole Antenna From http://en.wikipedia.org/wiki/dipole_antenna, Dec. 21, 2011.

Pifa Theory From http://www.antenna-theory.com/antennas/patches/pifa.php, Nov. 22, 2102.

"Linear arrays: Currents, impedances, and fields, I", R. King, IEEE Transactions on Antennas and Propagation—Trans Antennas Propagat , vol. 7, No. 5, pp. 440-457, 1959.

* cited by examiner (a)

(b)

(a)

(b)

(a)

(b)

(a)

(b)

ANTENNA ELEMENT AND ANTENNA DEVICE COMPRISING SUCH ELEMENTS

This application is the U.S. national phase of International Application No. PCT/GB2012/053196 filed 19 Dec. 2012 which designated the U.S. and claims priority to GB 1122324.5 filed 23 Dec. 2011, the entire contents of each of which are hereby incorporated by reference.

FIELD

The present invention relates to the field of compact antenna elements and miniaturised antenna devices comprising such elements.

BACKGROUND

Over the past few years, there has been an increasing worldwide research interest in multiple-input-multiple-output (MIMO) systems, also known as multiple-element antenna (MEA) systems, as they have been shown to have the potential for improved capacity, spectral efficiency and reliability as compared to single-antenna communication systems. MIMO technology is a breakthrough in the field of modern wireless communications, and is poised to play a significant role in the implementation of next generation's wireless products and networks.

MIMO systems consist of multiple antennas on both the transmitter and receiver ends. It is regarded as an extension to Smart Antenna systems, which consist of multiple antennas controlled by algorithms optimising their spectral and spatial efficiency.

The antenna is an extremely important component in any wireless appliance because it transmits and receives radio waves. An antenna operates as a matching device from a transmission line to free space and vice versa. An ideal antenna radiates the entire power incident from the transmission line feeding the antenna from one or more predetermined direction. Performance of the antenna dictates performance of most wireless devices and hence is a critical part of the system.

In current mobile and handheld devices, miniaturised antennas are formed by providing conductive patches and or traces on one of both sides of an insulating (or electric) substrate. The substrate may be part of a circuit board carrying other components, or part of the housing or chassis. This type of antenna may be regarded as a patch antenna, optionally with microstrip antenna features.

A number of antennas and RF circuits may be necessary to cover all the bands from 700 MHz up to 5 GHz, appropriate for applications ranging from GSM, CDMA, 3G, WiFi, Bluetooth and GPS. This not only increases the real estate required but also increases the chance of free space coupling and interference between antennas, thereby reducing the efficiency of the antenna.

Spiral antennas are well known in the art as means to provide coverage over a broad range of frequencies. The most popular configurations in the past have been Archimedean and Log spiral antennas. These have rarely made it to mobile devices in a form that has been easy to integrate either onto circuits or the chassis.

A miniaturised spiral antenna element is described in U.S. Pat. No. 6,791,497 (WO 02/29928A2), wherein the spiral antenna exists on one side of a substrate, whilst the second surface contains a planar balun and feed point which feeds the antenna element through a slot. This is said to cover a range of 800 MHz to 3 GHz. Slow wave structures are introduced as part of the spiral wind, which are said to make the device geometrically smaller for the same wavelength.

On the other hand, U.S. Pat. No. 6,295,029 B1 describes a microstrip antenna element which is formed as a rectangular spiral. This enables miniaturisation and maintains the broadband characteristics. At the end of the antenna an open stub is formed to assist in antenna matching. A ground plane for this antenna element is on the same side as the antenna, and a hole is punched in the ground to provide frequency shifting and a smaller size antenna element. However there is no discussion of the gain of the antenna, nor the impact of any neighbouring devices or other antenna elements that may affect the efficiency of the antenna element concerned.

WO 03/094293A1 discloses a miniaturised resonant slot antenna element which is fed from the back side of the substrate. Such a design is said to enhance impedance matching and reduce the physical size of the antenna, but may not improve the bandwidth of the antenna. US20060038724 describes a modified version of the same antenna, again fed from the back side of the antenna, with additional sub-slots, running clockwise and counter-clockwise, to improve the bandwidth of the antenna. The two multiple spiral slot antenna elements seen above mention the reduction of antenna size and slight improvement in the bandwidth. However it is believed that, when applied in a MIMO configuration, these implementations will not be efficient enough to provide a higher bandwidth as expected in modern portable communication systems.

U.S. Pat. No. 5,892,482 describes a circuit meant to reduce the mutual coupling between two patch antennas in an antenna for a cellular radio base station. A capacitor-inductor-capacitor network is used to couple neighbouring patch elements together, so as to inject into each one a signal in antiphase to that in its neighbour.

MIMO is expected to be a key technology to deliver the next generations of mobile devices, wherein a large number of protocols will be expected to run in parallel. This is envisaged to enable higher throughput of the devices within the limited channel bandwidth. The primary criteria of the antenna in these devices will be to reduce the co-channel interference and free-space coupling, also known as mutual coupling. There is another parameter known as envelope correlation, or cross correlation, which couples the radiation pattern of two such antennas when placed in proximity. The cross correlation can be reduced by decoupling the polarisation and placement of the antennas and by reduction of the beam width of individual antennas so they do not couple in free space, again relating to mutual coupling. However, for miniature equipment such as a mobile phone, the freedom of placement is very limited. Current design guidance is to place antenna elements at least a half wavelength apart in order to avoid grating lobes in the radiation pattern. A well-known reference in this area is R. King (1958) "Linear arrays: Currents, impedances, and fields, I".

A particular challenge is therefore to reduce the electromagnetic interaction in the near field with neighbouring antenna elements or devices which may be amplifiers, filters, GPS receivers, camera modules, casings, battery modules, memory, sensors, and other electronic components.

WO2011102143(A1) proposes to use additional circuitry to try and adjust the mutual coupling between two antennas. The present inventors prefer to mitigate the need for such external circuitry by virtue of the antenna design itself.

SUMMARY

The invention provides antenna elements and devices as defined in the appended claims.

The spiral slot, reduces the Q of the antenna, thereby increasing its bandwidth and reducing the antenna's susceptibility to interference and mutual coupling, whilst still maintaining an omnidirectional pattern. Further adjustment of frequency response can be made by secondary slots in the active patch, along with the location of the ground lines and notches.

The parasitic ground enables an enhanced antenna radiation pattern enabling diversity and a reduced mutual coupling in the near field, thereby allowing compact antenna arrays. The antenna in one embodiment consists of a linear polarised patch antenna, with a spiral slot and balanced ground feed.

Further use of a parasitic ground patch with a slot or aperture increases directivity, thereby allowing size reduction of multi-element antenna devices, and enhances the gain of the antenna. In embodiments illustrated below, the ground patch is not connected conductively to the signal ground, only passively (parasitically) connected.

Compact antenna elements according to the invention can be designed for mobile devices to cover a wide frequency range, for example from 400 MHz up to 8.4 GHz, or even down to 100 MHz and/or up to 60 or 80 GHz.

Where the description and claims refer to "central" and "peripheral" portions of a patch, it is to be understood that no strict definition of "central" applies. The central portion is merely a portion of the patch that is generally surrounded by an outer or peripheral portion. Similarly, where the description and claims refer to a conductor as a "strip", "line" or "patch", no strict definition of these terms is intended, other than what the context requires.

The present invention will be apparent in its novelty and other characteristics after reading the detailed description and preferred embodiment in reference to the accompanying drawings.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1:
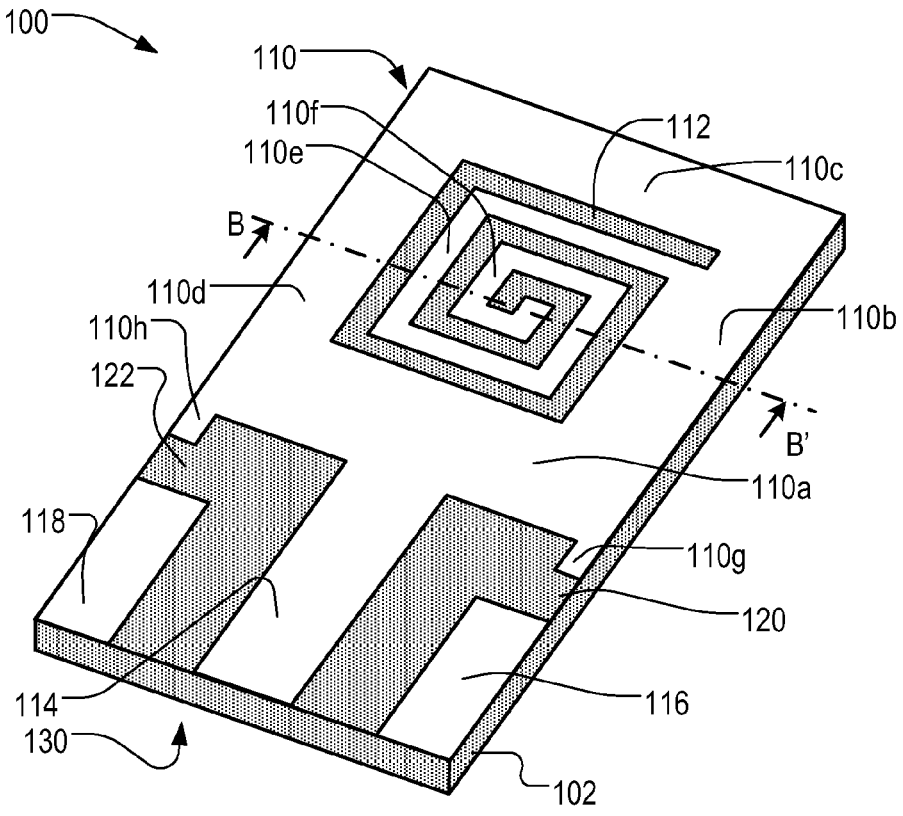
FIG. 1 shows (a) a top perspective view and (b) a transverse cross section of an antenna element according to a first embodiment of the present invention.
Figure 1:
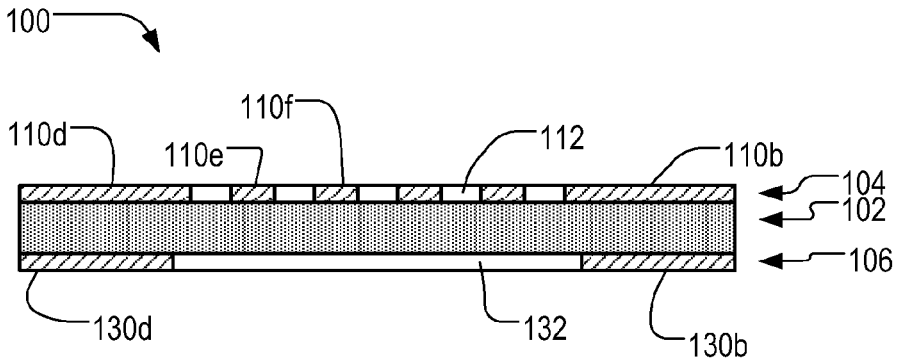
Figure 2:
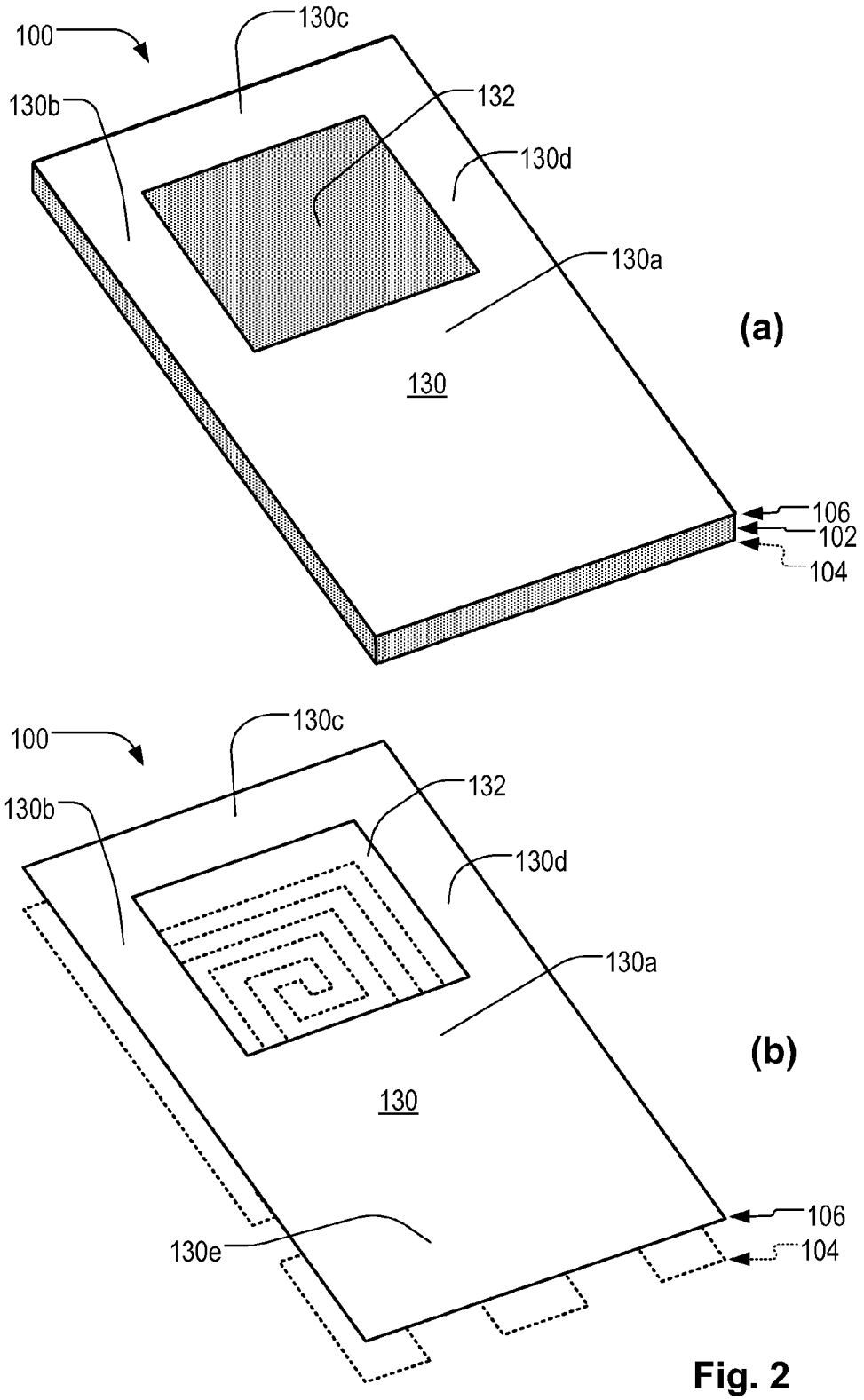
FIG. 2 shows (a) a rear perspective view of the same antenna element, and (b) the same view with the substrate removed.

FIG. 1 shows (a) a top perspective view and (b) a transverse cross section of an antenna element 100 according to a first representative example. FIG. 2 shows (a) a rear perspective view of the antenna element 100, and (b) the same view with the substrate removed. The antenna is made by forming conductive patches or traces on front and rear surfaces of an insulating substrate 102. Conductors on the front surface generally in a layer 104, form an 'active patch' of the antenna. Conductors 106 on a rear surface form a modified passive or parasitic ground patch. The substrate may be a circuit board of materials such as glass epoxy like FR4, or it may be a more particular material such as ceramic, alumina or quartz, silicon etc. In practice, the substrate can extend beyond the dimensions of the antenna, as will be seen in later examples. The conductors on both sides may be metal, for example copper, aluminium, gold, or any other suitable conductive layer.

On the front surface shown in FIG. 1(*a*) an active patch of the antenna comprises various conductive portions 110*a* to 110*h* in a generally square area. These elements are formed by modifying the conductive layer 104 with one or more spiral slots 112, which is formed (i) so as to form a square spiral of different-length segments 110*e*, 110*f* etc, and (ii) to leave relatively broad peripheral patch portions 110*a* to 110*d*, surrounding the square spiral area. To one side of the active patch, a co-planar feed conductor 114 is formed, which is flanked by signal ground strips formed by patches 116, 118. Small extensions 110*g*, 110*h* from the square patch area extend towards the signal ground patches 116, 118 respectively, leaving gaps 120, 122 in between. These extensions enable a lower Q and lower mutual coupling in both the directional and omni-directional variants of the antenna. On the rear side of the substrate, as seen better in FIGS. 2(*a*) and (*b*), the second conductive layer 106 is formed into a ground patch having peripheral portions including 130*b* and 130*d*, but being interrupted by an aperture or slot 132. In FIG. 2(*b*), it can be seen that slot 132 is formed at a location generally behind the spiral traces 110*e*, 110*f* etc of the active patch antenna on the front surface.

More detail and variations of the ground patch design will be discussed further below. While a generally square patch antenna with square spiral slot is used as an example, this square form is only an example and any rectangular, or more generally polygonal, geometry can be considered as well. Smoother curved shapes are also possible, but rectangular/polygonal designs tend to be easier to design and manufacture. While a spiral slot is used in the examples, the principles of the invention can be extended to other forms of convoluted slot, such as serpentine or linear or segmented linear.

The active patch of the antenna element has been modified with spiral slot 112 so as to give the antenna element wideband performance. Further, optional modifications to be described later provide not just for the broadband performance but also for an increased gain, a highly directive radiation pattern and reduced mutual coupling between multiple antenna elements. These different embodiments of the antenna element include for example additional slots to give additional frequency response. In the square patch the slot induces the current to cross larger electrical lengths thereby covering larger frequency range. The directions of the currents induced into the device and the aperture are selected in a manner that the electromagnetic waves radiated into space will introduce less mutual coupling amongst other neighbouring device. The thicker external patch formed by portions 110*a* to 110*d* protects the inner currents from external sources. The passive (parasitic) ground patch 130 also plays a key role. The ground patch with aperture 132 is strategically placed under the active path, in order to balance the fringing fields and enhance the radiation pattern of the antenna element. The antenna is also balanced fed, using signal ground strips (patches 116, 118), making it less susceptible to proximity effects, and ideal for embedded applications such as handheld mobile devices.

By adjusting the design of the slots in the antenna elements and associated parasitic elements, individual parameters can be varied to provide enhanced performance, suitable for compact antenna arrays. In particular, the directional property of the individual antenna element allows the overall antenna array to have a higher gain, lesser mutual coupling, lesser envelop correlation and large bandwidth from 400 MHz to 8.4 GHz.

By applying the principles described above one can provide a UHF antenna, which is less than $1/16^{th}$ the size of its traditional counterparts working at the same frequency from 300 MHz up to 3 GHz in UHF (Ultra High Frequency) bands, and 3 GHz up to 30 GHz in SHF (Super High Frequency) bands. This allows for a compact integrated element and element arrays suitable for modern portable communication systems. All this is achieved solely on the basis of patch design and not by having any additional circuitry attached to the antenna. Examples of the novel antenna have been successfully tested in the range 0.3 GHz to over 8 GHz, but the principles of its design can be applied in other frequency ranges. In general terms, we would anticipate covering roughly a decade of frequencies with a single design, for example, 0.3 to 3, 3 to 30 or 8 to 80 GHz. We have examples that cover significantly more than a decade, however. Other forms of convoluted slot are possible. In alternative embodiments, where wide bandwidth is not required, a simpler slot shape could be used, while maintaining the other features and benefits of the embodiments to be described below.

In multi-element applications, the available bandwidth may depend also on an acceptable mutual coupling between elements. Where a lower degree of mutual coupling is desired, then for a given geometry less of the spectrum may lie under that dB threshold.

As explained before, MIMO requires that the elements should have a low mutual coupling less than for example −10 db, −13 dB or −15 dB or −20 dbB. The invention by virtue of its design and control of the radiation pattern enables an ultra wideband characteristics ideal for a smart antenna system. Examples illustrated below provide a mutual coupling of −16 dB to −67 dB, over the entire spectral range of 400 MHz up-to 8.4 GHz. This makes it very interesting for the next generation of mobile MIMO devices. The concept of having the least electromagnetic interaction in the near field and maximum interaction in the far field allow beam forming if desired.

As is known, a single sided patch antenna lacks in bandwidth and has an omni-directional radiation pattern. The addition of a parasitic ground patch or reflector on the back side of the substrate increases the efficiency of radiation (reduces return loss). In some embodiments of the invention the parasitic ground patch 130 is modified to create a slot 132. This allows the designer to blend higher gain and efficiency with a highly directive pattern. A higher directivity means the antenna radiates or focuses its energy in a particular direction compared to the average of all other directions. More focused means less energy wasted in other directions and saves radiated power and reduces noise. In the case of cellular communications, for example, it also allows a particular cell to be chosen in preference to others, and for multiple reflections to be eliminated, ensuring that only one desired signal is selected from a range of interferers.

As a key application for the antenna elements are to be designed is for a modern system which enables MIMO, the inventors have studied the effects of the antenna elements combined into an array form. The active patch without the ground patch exhibits significant coupling between two adjacent antenna elements. However with the modified ground patch and feed structure, the coupling was significantly reduced. Over the entire range from 300 KHz to 3 GHz in one example, the two elements displayed a coupling between −15 dB to −67 dB.

For a typical MIMO application the free space coupling should be low, for example below −10 dB, or even lower and experiments with the novel element have proved that this performance is achievable, even with elements in fairly close proximity.

Consequently, having a preferred balance between a modified slot in the square patch and the ground, leads to a higher directivity, higher gain, and more focused radiation pattern and reduces mutual coupling between a plurality of elements.

Figure 3:
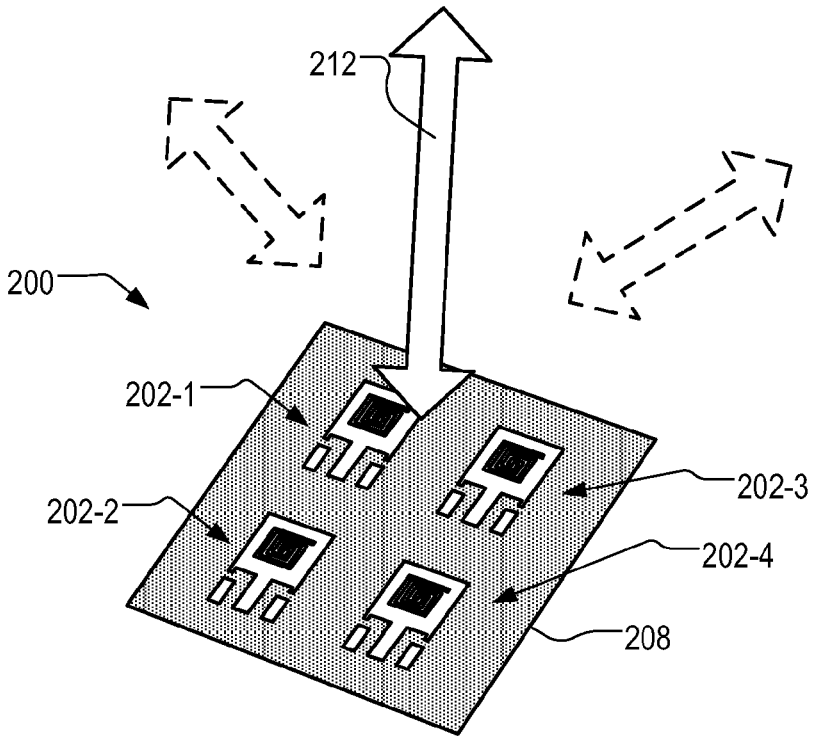
FIG. 3 is a schematic view of an antenna device comprising an array of novel antenna elements of the type shown in FIGS. 1 & 2.

FIG. 3 shows schematically an antenna device 200 comprising an array of novel antenna elements 202-1 to 202-4, each of the form described above. These elements may be employed as a "smart antenna" device, or in MIMO applications. The antenna elements, four in this example, are formed on a common substrate 208. As described above, the novel elements have enhanced ultra-wideband (UWB) characteristics of the antenna, including reduced free space coupling. In the case of a smart antenna, the overall gain and directivity of the antenna can be controlled by controlling the amplitude, phase and electrical characteristics of a signal as it is fed to each element. The smart antenna, in a transmitting mode, receives a single RF input signal via the feed arrangement (not shown), and emits a beam 212 with a desired direction and directivity. In a receive mode, which may be operating simultaneously, the directional beam 212 represents a direction from which radiation is preferentially received, and a received RF signal is output via the same or a different arrangement. This creates a novel smart antenna in which spectral and spatial diversity, for example, can be tailored to an application. With active control of the phases between elements, the beam can be digitally controlled using a software algorithm.

Figure 4:
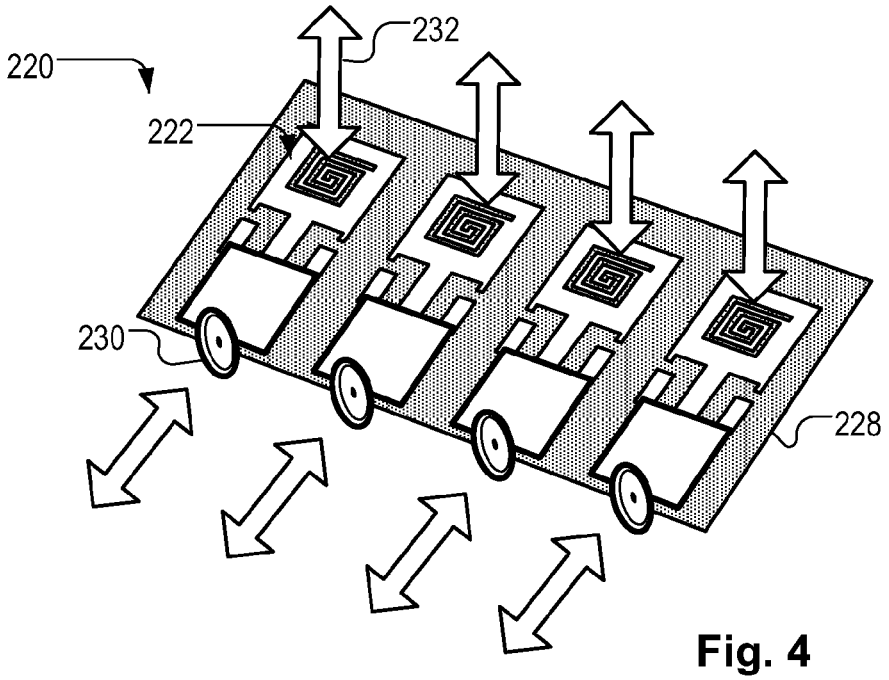
FIG. 4 is a schematic view of another antenna device comprising an array of novel antenna elements of the type shown in FIGS. 1 & 2.

FIG. 4 illustrates a multiple input, multiple output (MIMO) antenna array 220 comprising antenna elements 222 of the novel form described above, formed on a common substrate 228. Instead of a single RF input, each element has an associated RF device (switch, filter, matching circuit, etc.) with an input connector 230, so that multiple RF signals can be can be emitted or received and manipulated in parallel via multiple beams 232. The MIMO array is exploited to provide parallel data channels than can deliver enhanced data rates. The concepts of MIMO and smart antenna arrays can be combined, if desired.

There are three main ways of using MIMO systems: spatial multiplexing, beam forming and spatial diversity. Spatial multiplexing is a concept of particular interest, and is the main way MIMO systems differ from smart antenna systems. Beam forming is a concept common to both conventional smart antenna and MIMO systems. It refers to the concentrating of energy towards certain directions in such a way as to increase the signal-to-noise ratio (SNR) or signal-to-interference-and-noise ratio (SINR). For example, the receive array can form an array radiation pattern where the main beams are directed towards the transmitters to obtain a higher received signal strength, while nulls are introduced in the directions of interfering signals. This is done by weighting (either in amplitude and/or phase) the signals received by different antenna elements appropriately to maximise the contribution of the desired signal and concurrently minimise that of the interfering signals. Another key concept of smart antenna is spatial diversity, where the use of multiple antenna elements improves the reception/detection of signals. The presence of multiple antenna elements can counteract the effect of random fading due to multipath propagation. As a result, the probability of signal loss decreases exponentially with the number of uncorrelated antenna elements. MIMO systems harness the spatial diversity benefits of array antennas as well. However, MIMO systems have an added advantage over smart antennas in that they can enjoy both transmit and receive diversity gain.

In spatial multiplexing, the transmit data is split or multiplexed into several parallel streams and each stream is transmitted simultaneously across the channel by different transmit antenna elements (or channel Eigen modes, if the channel is known at the transmitter). The signals received on the multiple receiver antennas are thus a combination of the transmit data streams.

Figure 5:
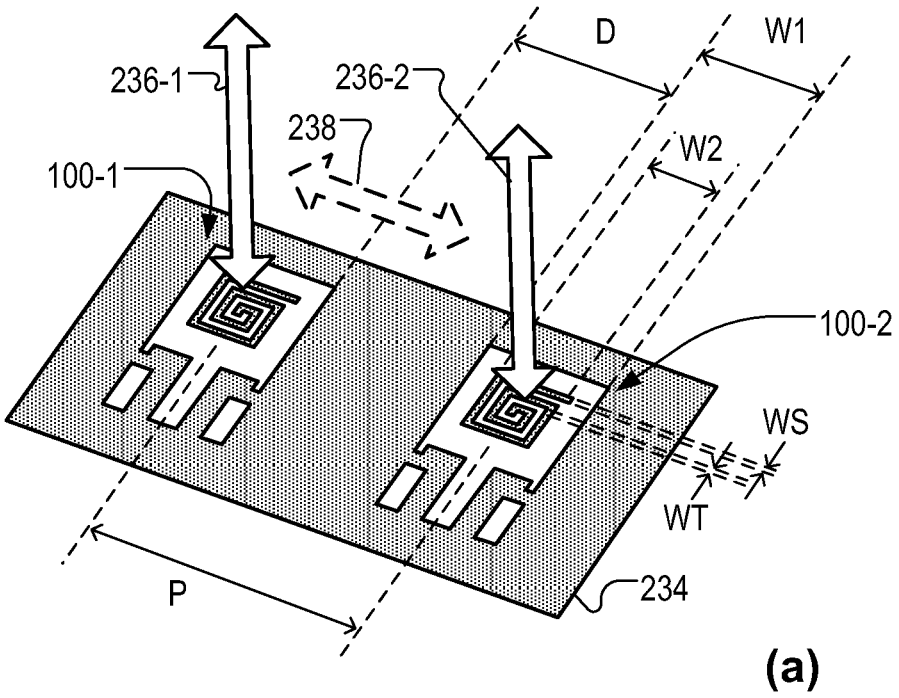
FIG. 5 illustrates performance requirements of an example antenna device comprising two antenna elements of the type shown in FIGS. 1 & 2.
Figure 5:
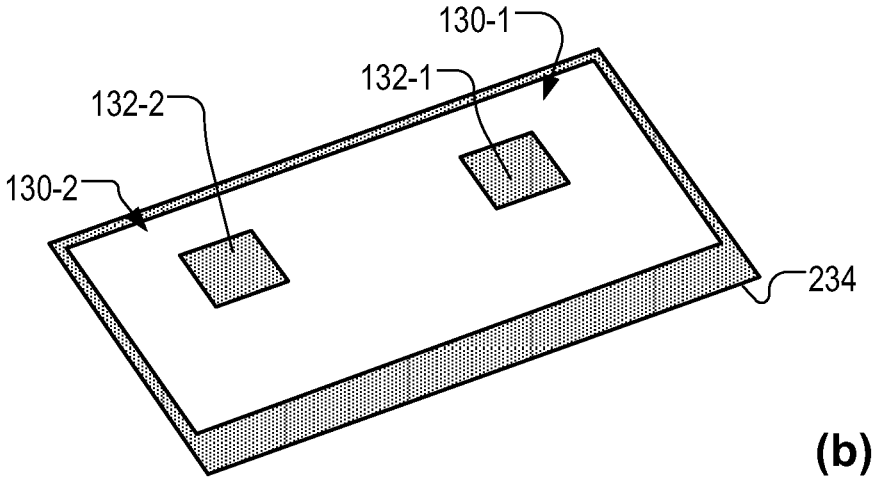

FIG. 5(*a*) illustrates some parameters of dimensions of the individual antenna elements, and space in between them in a multi-element antenna device. As mentioned, the key characteristic of the novel antenna elements is their degree of mutual coupling with neighbouring devices, and two antenna elements 100-1 and 100-2 illustrated for this discussion. The degree of mutual coupling between those devices, and/or between these devices and neighbouring circuitry, is key to their utility in compact antenna arrays, whether for "smart antenna" applications (as in FIG. 3) or MIMO applications (FIG. 4). The elements are shown formed on a common substrate 234. As seen in FIG. 5(*b*), their ground patches 130-1 and 130-2 on the back side of the substrate may be continuous with one another, rather than discrete. Each ground patch is identifiable by its slot 132-1, 132-2, positioned behind the spiral slot portion of the corresponding active patch.

"Mutual coupling" refers to the electromagnetic interactions between the elements of an antenna array, or between independent antennas in close proximity to each other. Some of the energy transmitted by a transmit antenna element is transferred to the other elements. Correspondingly, a portion of the energy in the incident field of a receive antenna element is transferred to the nearby elements. As a result, the feed current on each transmit antenna element in an antenna array does not solely consist of the current as when they are transmitting in isolation, but also of the current induced by the other antenna elements in proximity. The same argument follows for the induced current on the receive elements of the array.

Another way of describing the effect of mutual coupling is that the electric field generated by one element alters the current distribution, as well as distorts the radiation/reception pattern of the other elements as compared to their isolated radiation/reception patterns. The amount of mutual coupling depends on the separation between antenna elements. It generally increases the closer the antenna elements are to each other, but the relationship will be complex and frequency-dependent The extent of mutual coupling also depends on the element radiation patterns and the array geometry, for example the relative orientation and location of the antenna elements. The direction of arrival (DOA) of the incident field also affects mutual coupling. Due to this, mutual coupling plays an important factor in the design of smart antennas and multi-element antennas in general.

Referring again to FIG. 5(*a*), the active patch on the front side of substrate 234 for each antenna element 100-1, 100-2 has a spacing D from the edge of the active patch of the neighbouring element. The active patch has an outer dimension W1 in the direction of distance D, while the spiral slot portion within the active patch has an outer dimension W2. A pitch dimension P is defined between the centres of the active patches. In the central portion of the active patch, dimension WS is defined as the width of the spiral slot 112, while WT is the width of a trace 110*e*, 110*f* etc formed by the spiral slot. In a rectangular, rather than square, embodiment, each of these widths may be defined separately in different directions. Each element 100-1, 100-2 receives its own radiation beam 236-1, 236-2. A near field mutual coupling between the elements is designated 238. Where the elements are positioned end-to-end (as is the case for elements 202-1 and 202-2 for example in FIG. 3), the distance D can include the feed arrangement.

In embodiments of the invention, it has been mentioned that the elements can be placed closer together than known antenna designs, without undue mutual coupling. For example, the outer dimension W1 of the active patch may be between 10 mm and 20 mm, for example between 14 and 18 mm. The inner dimension W2 may be between one third and three quarters of the outer dimension. The spacing D may be in the range 2-50 mm, for example being less than 50 mm, 40 mm, 30 mm, 25 mm, 20 mm, 15 mm or 10 mm. The spacing D may be less than 2 times the outer dimension W1, or less than 1.5 or 1 times. The spacing may be selected also to provide a mutual coupling across a range of operating frequencies that is less than −10 dB, less than −14 dB or less than −18 dB, for example. The spacing D and/or the pitch P may be less than 0.5 times the wavelength λ at a highest operating frequency for which the antenna is designed ($D<=\lambda/2$). At lower operating frequencies, the wavelengths will be longer and so the gaps between element will be much shorter, in wavelength terms. When embodiments of the invention are properly designed, satisfactory mutual coupling performance can be obtained when the spacing D is as low as λ/100, λ/300 or even λ/400. It may be envisaged that an antenna element may operate at several frequency bands in a given product application. The mutual coupling is only an important performance criterion in those bands where smart antenna and/or MIMO functions are being implemented.

Figure 6:
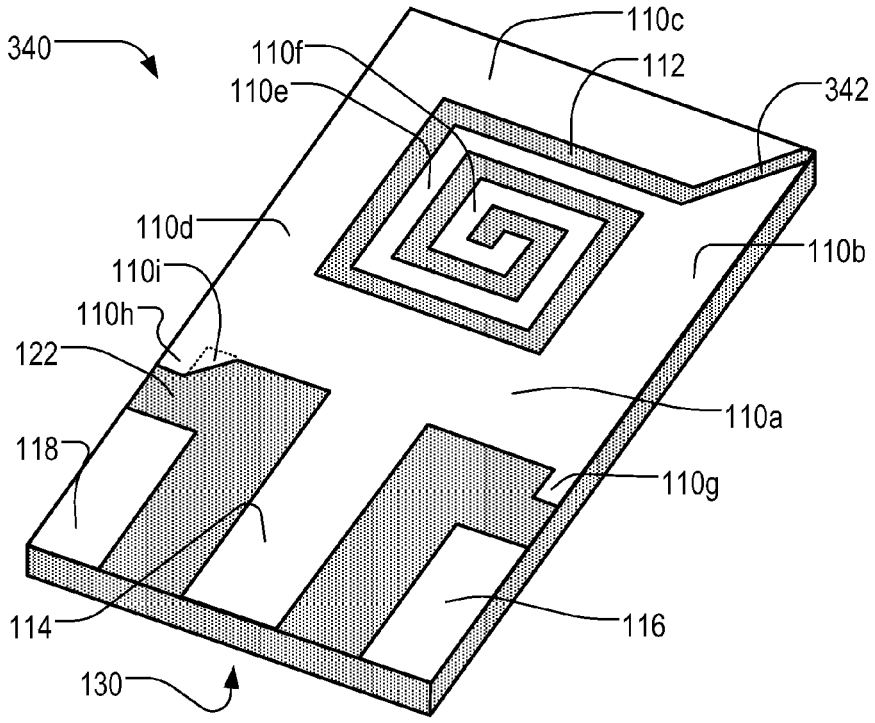
FIGS. 6, 7, 8 and 9 illustrate modifications of an active patch of an antenna element, for use in alternative embodiments of the present invention.
Figure 7:
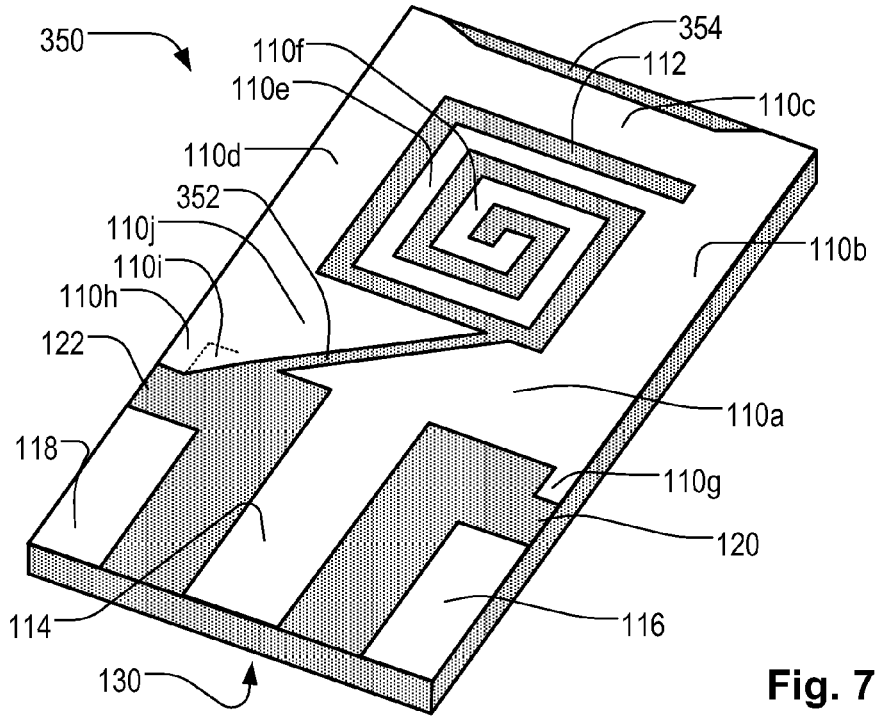
Figure 8:
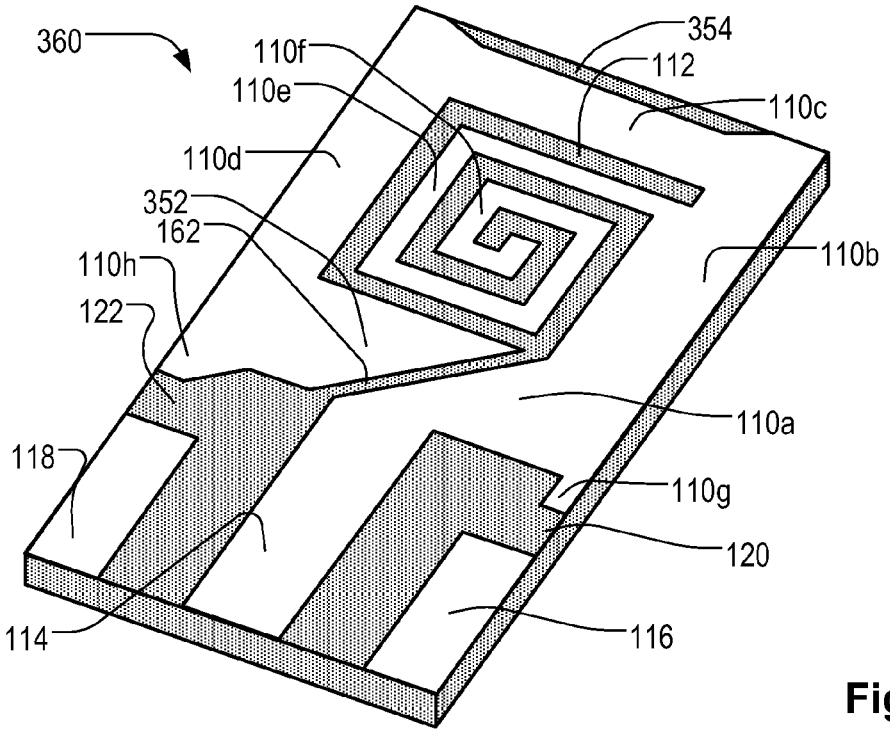

FIGS. 6 to 8 illustrate variations of the active patch design, forming alternative embodiments of antenna element 340, 350, 360 and 370, based on the general form of element 100 shown in FIGS. 1 and 2. Throughout FIGS. 6 to 9, the same reference signs 110*a* etc are used for the same parts as in the example of FIG. 1. The following discussion will highlight only the additional features specific to these modified embodiments.

In FIG. 6, antenna element 340 is the same as element 100, except for an additional or secondary slot 342 which extends the spiral slot 112 so as to disconnect outer patch portions 110*b* and 110*c*. From experimental results it is noticed that the frequency of operation is varied slightly, FIG. 6. The patch edge is also varied by a small extension 110*i*, which is an additional piece of conductive material near the ground strip gap 122 at one side of the active patch only. The extension which improves coverage at higher frequencies and also improves (reduces) mutual coupling, by the effect of capacitance with the ground patch. The need for separate capacitive circuitry such as in U.S. Pat. No. 5,892,482 is reduced. Additional extensions could be provided at either side or both sides.

FIG. 7 shows modified element 350, which is the same as element 100 except for an added or secondary slot 352 which bisects peripheral patch portion 110*a* to form a separate portion 110*j*, to one side of the feed strip 114. The outer edge of peripheral portion 110*c* is modified by a slot 354. This modification alters the frequency response of the antenna, for example by adding additional resonances. It can therefore be employed to support and additional frequency band or bands.

FIG. 8 shows a further modified example element 360. This is the same as element 350 of FIG. 7, except that the secondary slot 362 is in a slightly different position, extending from one corner of the spiral slot 112.

In each of these variations, we see the active patch of the antenna element being modified with further slots. This helps to extend the UWB characteristics of the antenna element. The position of the slot will define new boundaries and lengths for the electrical path and hence require current to travel further. This forms effectively inner and outer loops or segments of the antenna element, each working as an independent spiral antenna with its own resonant behaviour. Adjusting the position of secondary slots 342 or 352 can tune this resonant behaviour by altering the absolute and relative length of the segments. It also helps to overcome any interference from neighbouring radiating antenna elements thereby reducing the mutual coupling and interference posed by other electrical devices.

Figure 9:
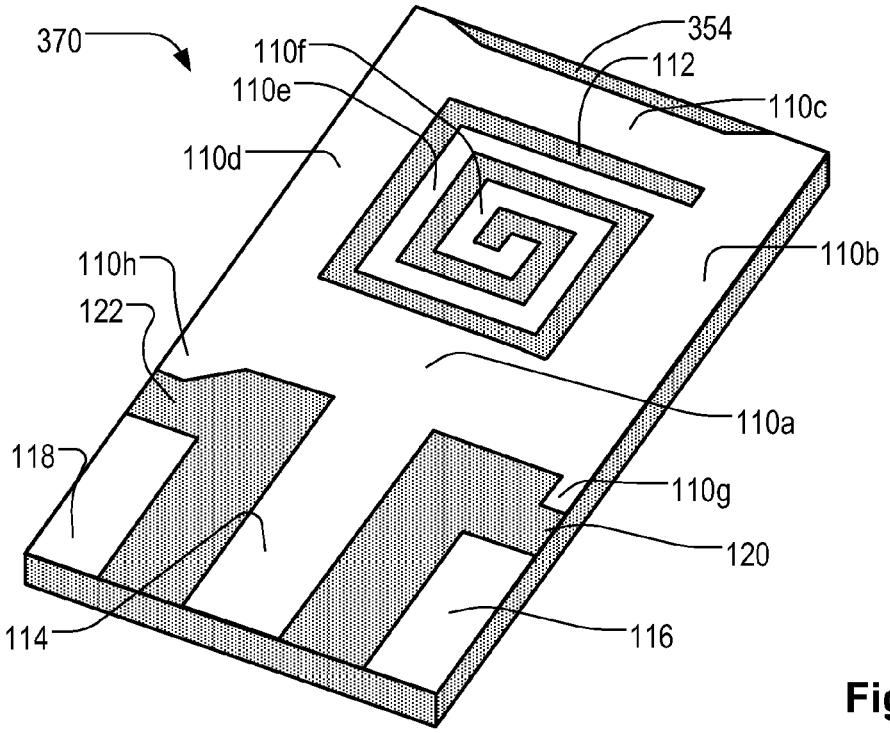
Figure 10:
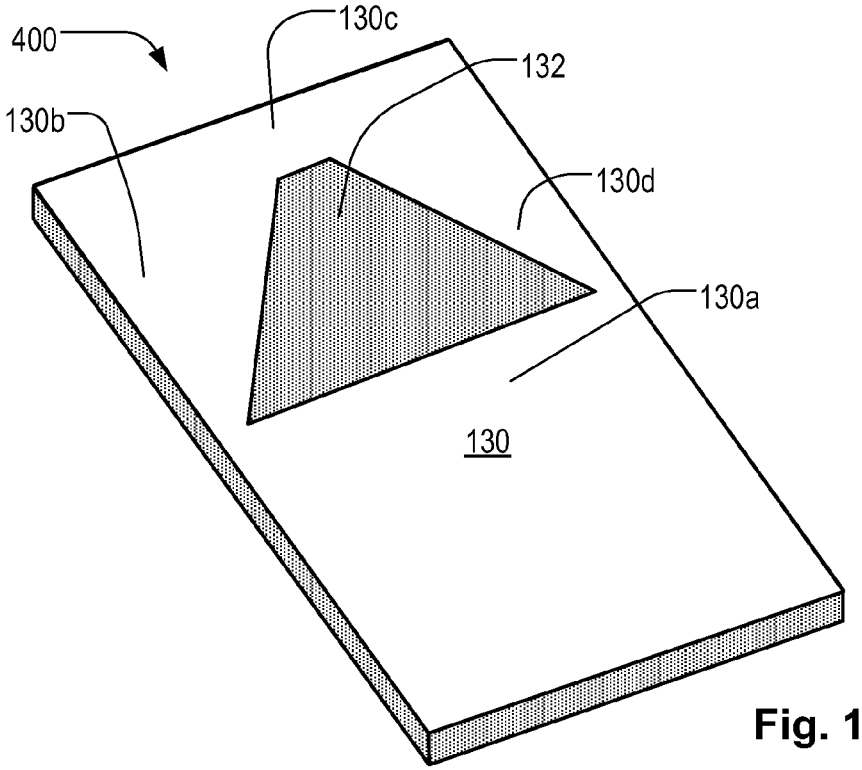
FIGS. 10, 11, 12 and 13 illustrate modifications of a ground patch of an antenna element, for use in alternative embodiments of the present invention.
Figure 11:
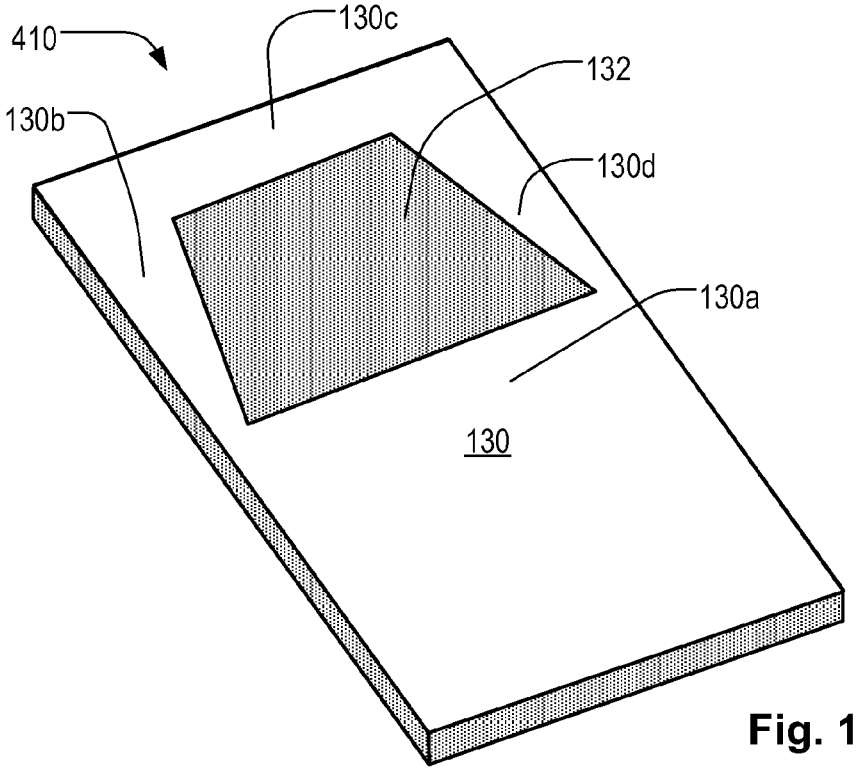
Figure 12:
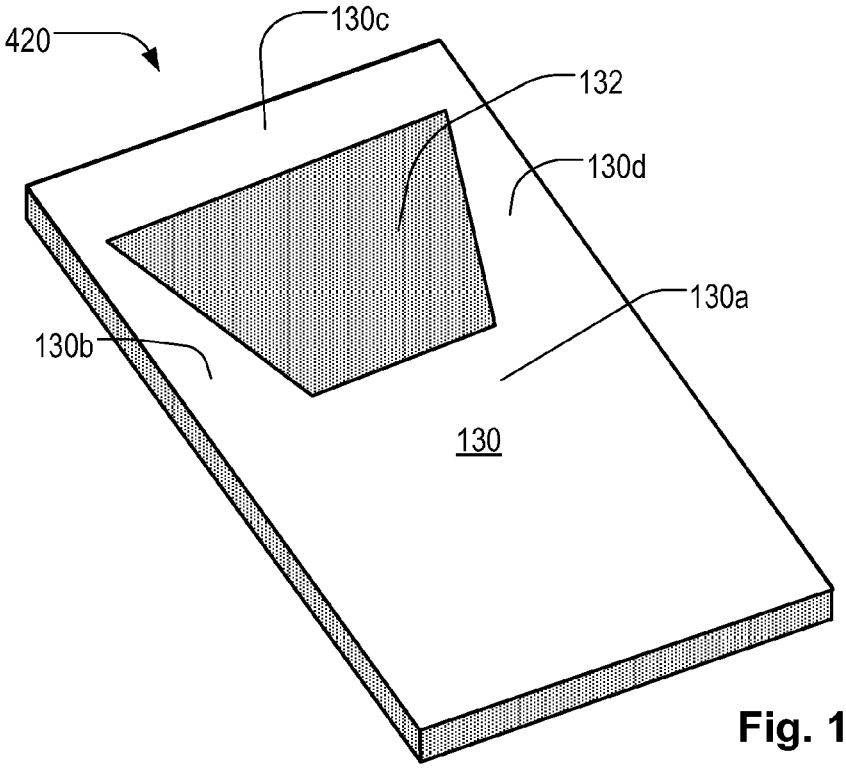
Figure 13:
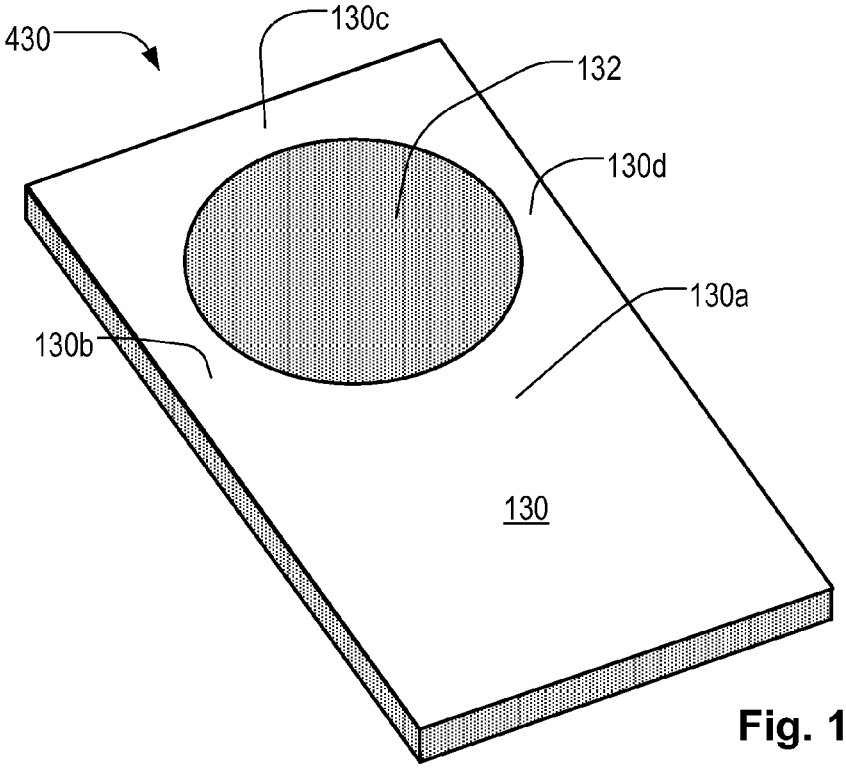

FIG. 9 shows an element 370 which is the same as element 100 except for the provision of slot 374, similar to slot 354, at the peripheral portion 110*c* of the active patch, opposite the feed strip 114.

FIGS. 10 to 13 show the back side of modified antenna elements 400, 410, 420 and 430. Different shapes of slot 132 are provided in the modified ground patch 130 on the opposite side of the substrate from the active patch spiral slot. Each shape of ground patch slot adds a distinctive property to the overall antenna element. The alternative active patch designs of FIGS. 1, 6 to 9 can be combined freely with the modified ground patch designs FIGS. 10 to 13, to permit a wide choice of characteristics. This enables individual antenna elements and an antenna array fabricated by combing multiple antenna elements to function better in certain applications.

Numerous permutations and variations of the features described above can be deployed to customise an antenna element for its particular application. It may be assumed from the above description that elements in an array will be identical, but this is not necessarily the case. The spiral slots, secondary slots, extensions, notches etc. of the active patch and/or the ground patch may be varied according to the position of each element in an array, for example, or to provide different operating bands in a switchable array. Secondary slots can be deployed in the peripheral portion of the ground patch, not only the active patch. The spiral slot in the active patch may be swapped for a different design of convoluted slot.

Figure 14:
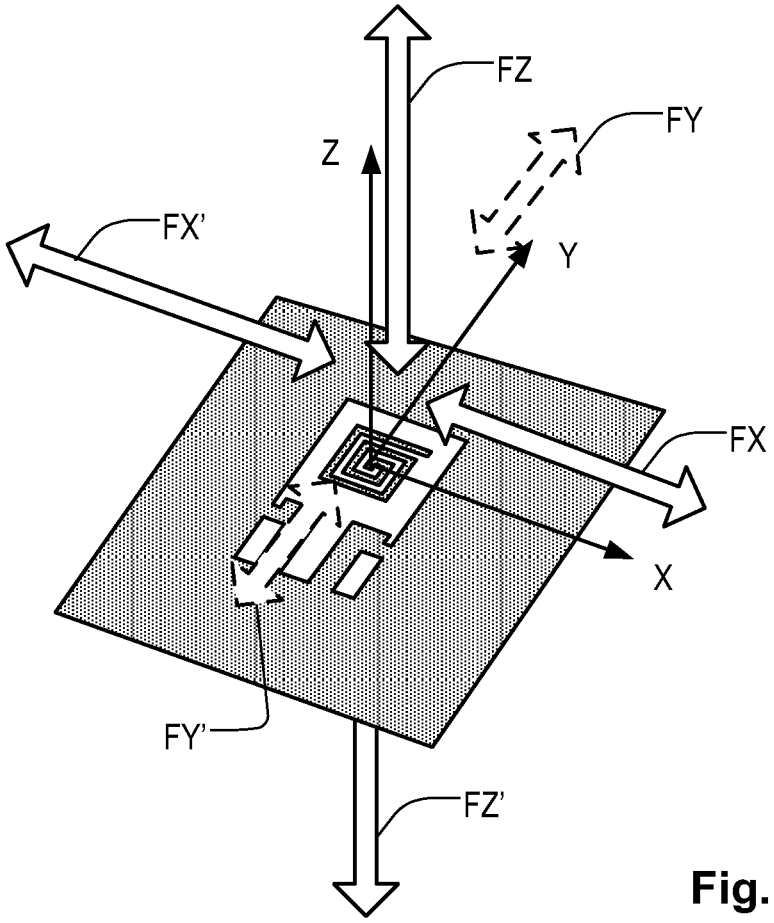
FIG. 14 illustrates a coordinate system for the discussion of radiation patterns.
Figure 15:
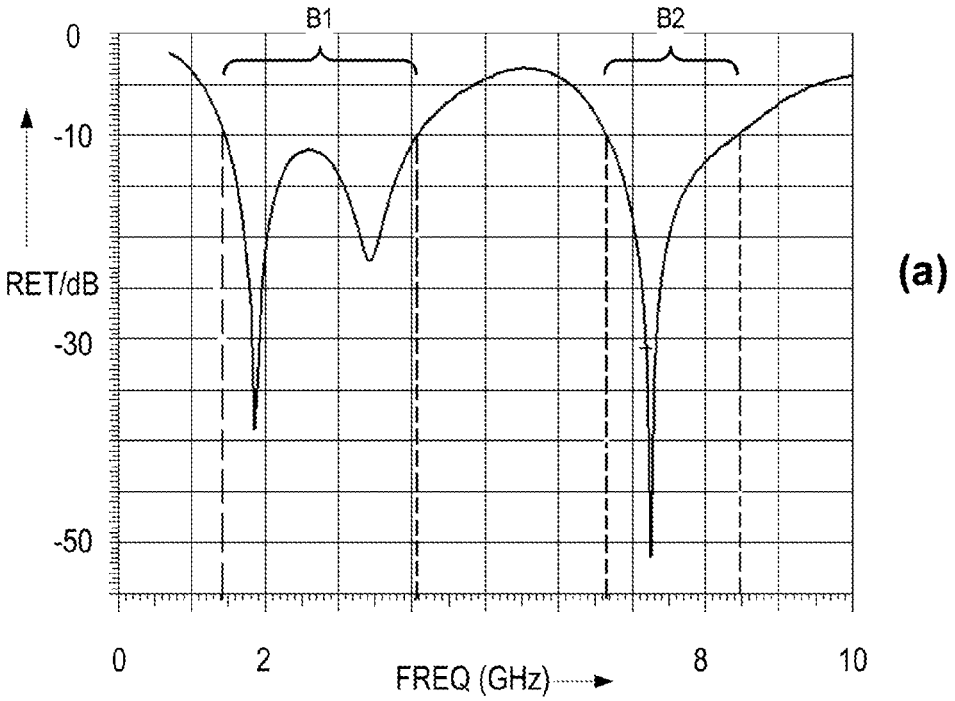
FIGS. 15 to 20 present (a) return loss against frequency and (b) radiation patterns at and example frequency 2.45 GHz, for a variety of antenna designs selected from the above examples.
Figure 15:
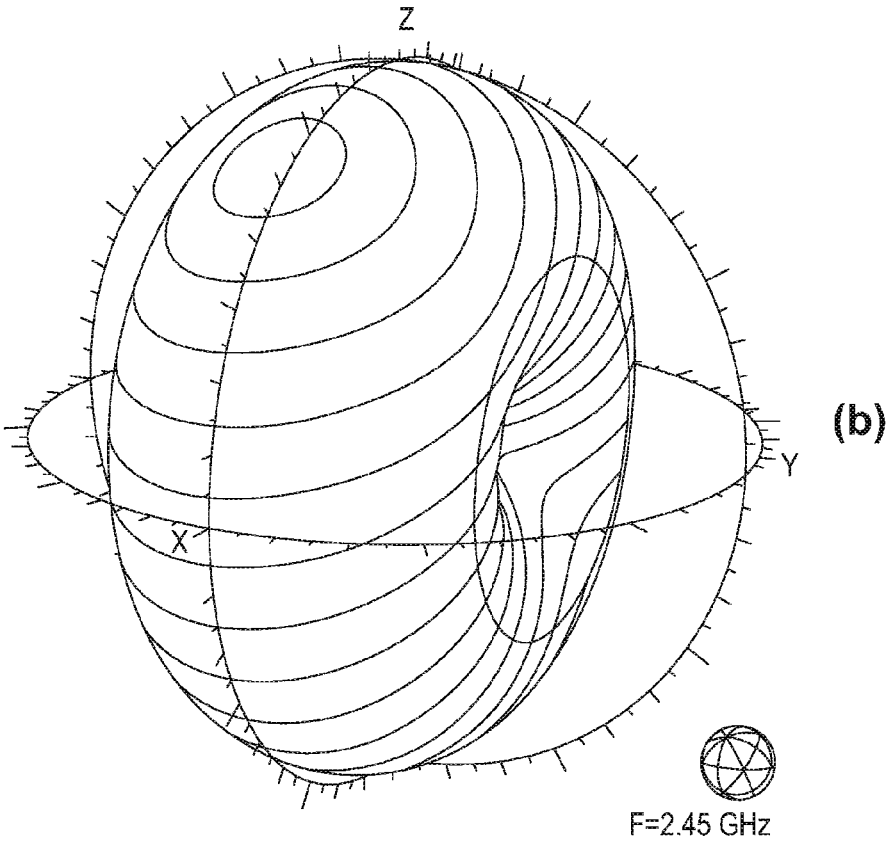

FIG. 14 illustrates a coordinate system for the presentation of directional radiation patterns. FIG. 15 onward show spectral performance and directionality characteristics for various antenna elements and arrays made according to the principles described above. IN FIG. 14 the Z axis is defined as normal to the active patch with fields FZ (forward) and FZ' (rear). The X axis extends in the plane of the patch and transversely with respect to the feed direction and with fields FX and FX'. The Y direction extends in the plane of the patch but parallel with the feed direction, with fields FY and FY' as illustrated. As in the case of a simple dipole antenna, this direction tends to be a null in the radiation pattern, so the fields FY and FY' are shown in broken lines.

FIG. 15(*a*) shows return loss against frequency for an element having the spiral slot and a plain ground patch 130 (without slot 132). The addition of the spiral slot reduces the Q of the antenna. This in turn increases the bandwidth of the antenna and allows for multiple resonant bands. As the skilled reader knows, the lower the return loss (higher negative dB value), the better the antenna is at radiating a signal at the frequency in question. A return loss below −7 or −9 dB indicates a usable antenna. Sub-bands B1 and B2 are indicated in FIG. 15(*a*), where the return loss is below −10 dB, and consequently transmission is certainly usable. The extremes of these bands cover frequencies of 1.4 GHz and 8.4 GHz, a factor of six apart.

We can describe an antenna element as ultra wideband (UWB), even if its return loss is unacceptable at some points across the spectrum. A multi-purpose antenna can be designed to carry different signal types which might have widely different frequencies, but parts of the spectrum in between are unused. For the purpose of this description, we can define an UWB antenna or antenna element for example as one having usable spectral regions that are more than 5 GHz apart, or more than two octaves apart. We can define usable regions as those having a return loss better than −7 dB, −9 dB or −10 dB, for example. Examples according to the embodiments described above have two or more regions at least 1 GHz in width, possibly 2 GHz in width. The sub-band B1 with two resonant peaks in it covers a range of more than an octave.

The parasitic ground patch without a slot results in an omnidirectional radiation pattern as shown in FIG. 15(*b*). This toroidal radiation pattern is similar to that of a classic dipole antenna, with nulls along the Y axis.

Figure 16:
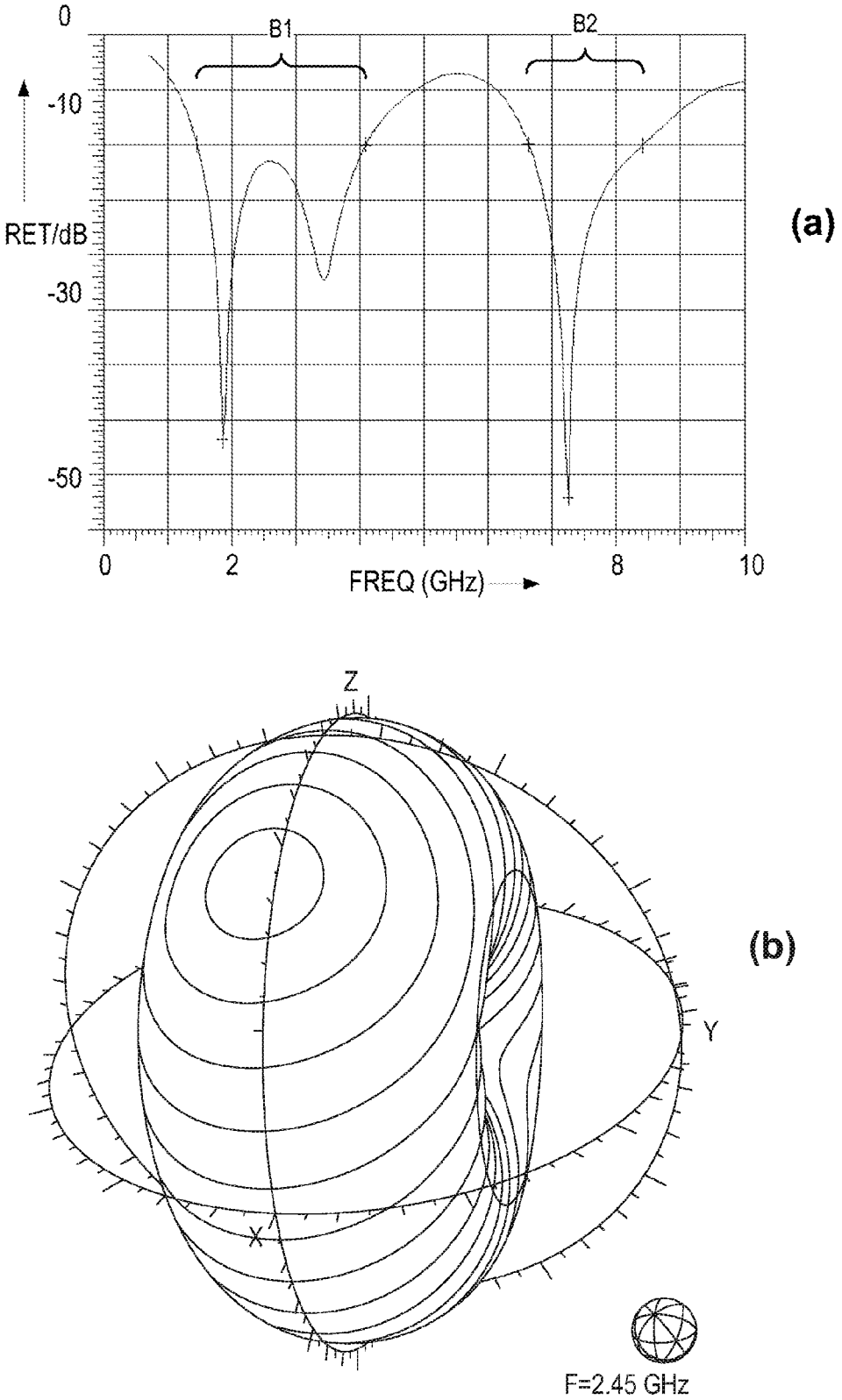

FIG. 16 illustrates (a) the return loss and (b) the radiation pattern of a similar antenna element, but with the notch 110*i* such as that illustrated in FIG. 6. Introducing the notch 110*i* produces a slight shift in the frequency of spectrum features.

Figure 17:
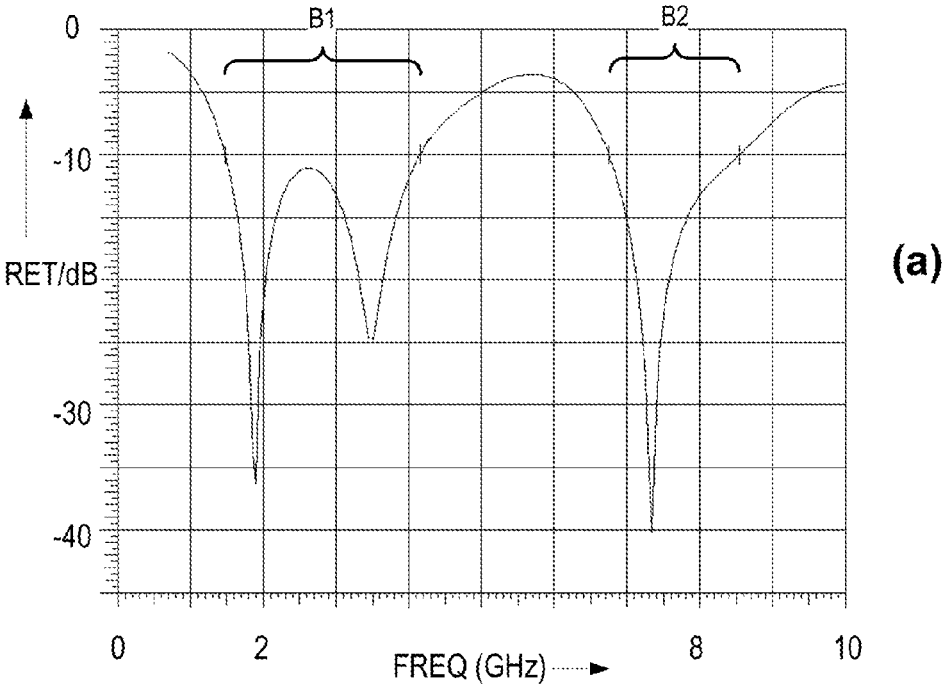
Figure 17:
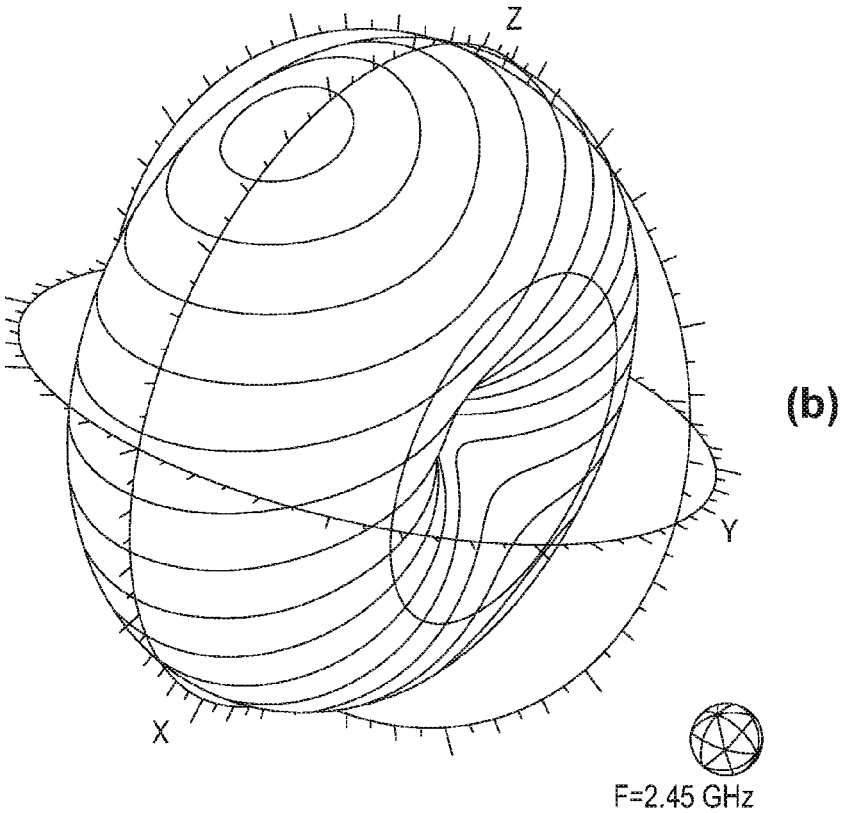

FIG. 17 shows the performance of a third variation of the antenna where the edge of the patch is being cut further in, as seen at 354 in FIG. 9. Comparing the previous graphs, this variant shows a shift in the operational frequency to a higher bandwidth.

The next few variations will show the effect of additional secondary slots in the active patch of the antenna, of the type shown in FIGS. 6, 7 and 8 above.

Figure 18:
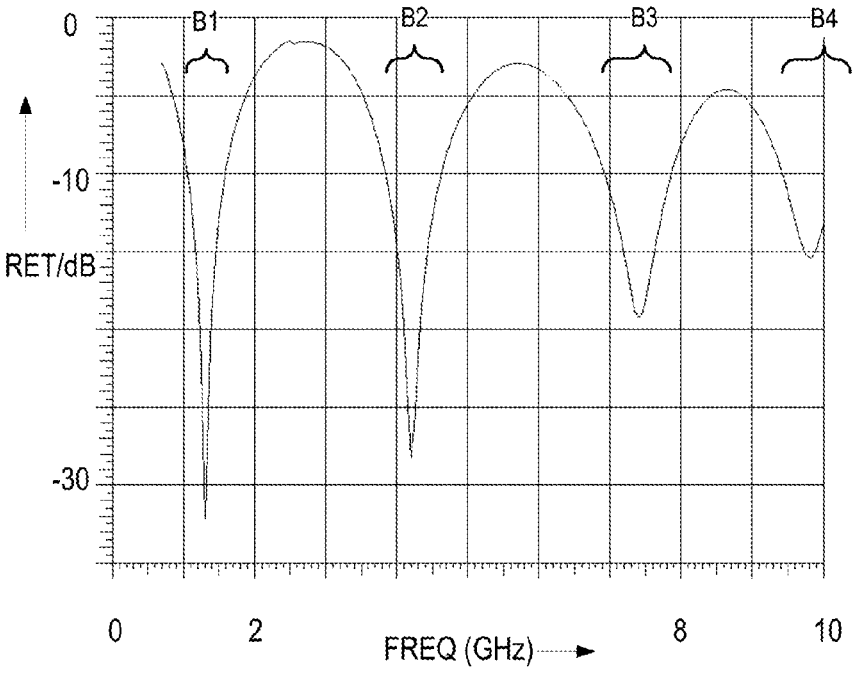
Figure 18:
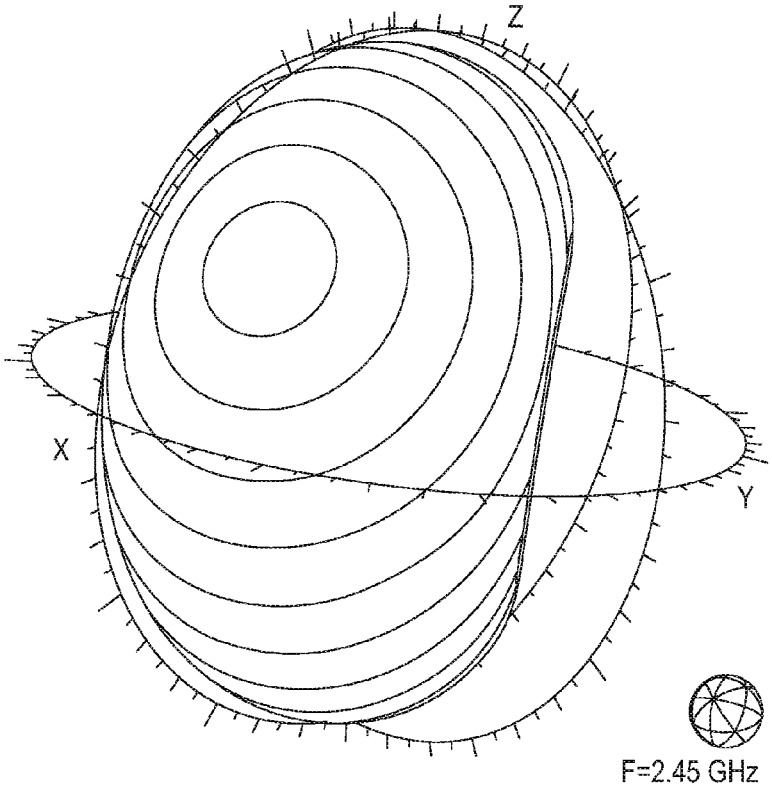

FIG. 18 shows return loss and radiation pattern for the example of FIG. 8 above, when the peripheral conductor portion 110*a* is cut diagonally it separates the square patch into two spiral antennas. What is noticed is that the ultra wideband antenna which originally produced a 3 GHz bandwidth now breaks down into three sub-bands B1-B3 of roughly 1 GHz bandwidth. However it now supports a higher order of frequencies in a sub-band B4, which go beyond 12 GHz. The original square patch being dissected close to the feed point as shown in FIG. 8 no longer supports a balanced feed and there is a mismatch at the feed. This causes the gain to reduce thereby reducing the antenna efficiency. However there are techniques to improve upon this.

Figure 19:
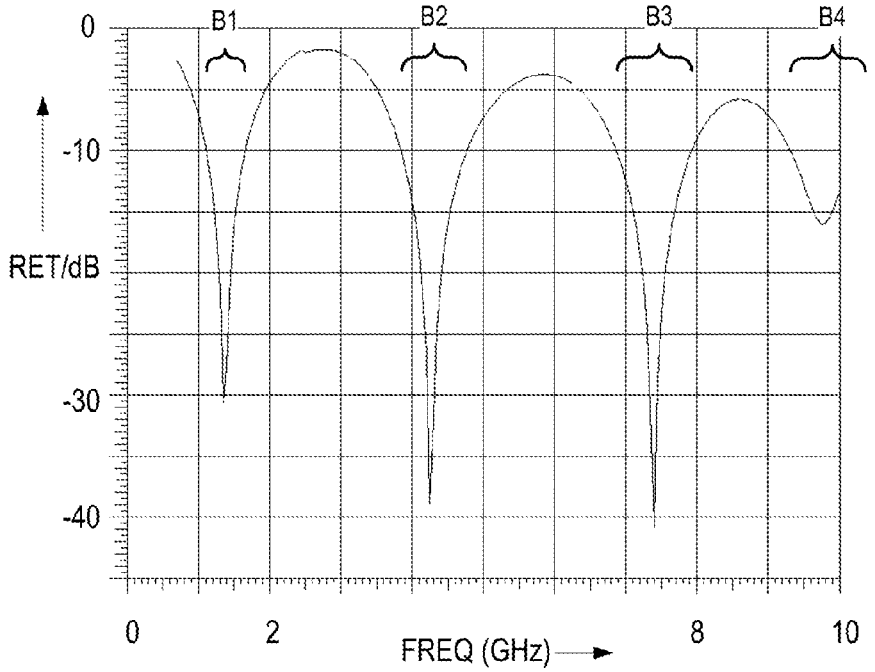
Figure 19:
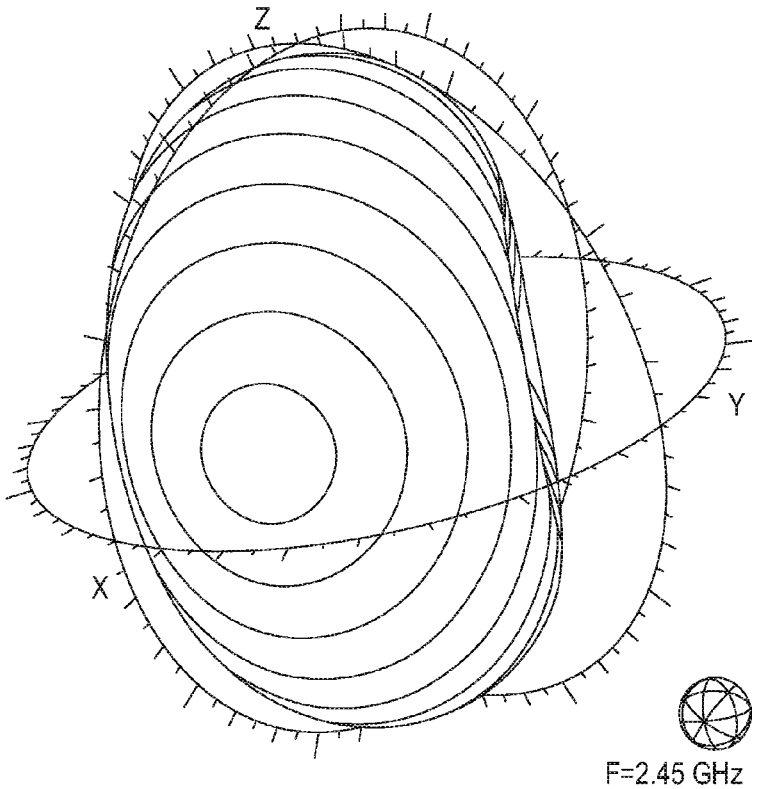

FIG. 19 shows the effect of variation of the secondary slot to the position shown in FIG. 7. What is noticed that performance in the higher frequencies (B2, B3) is improved compared with FIG. 18.

Figure 20:
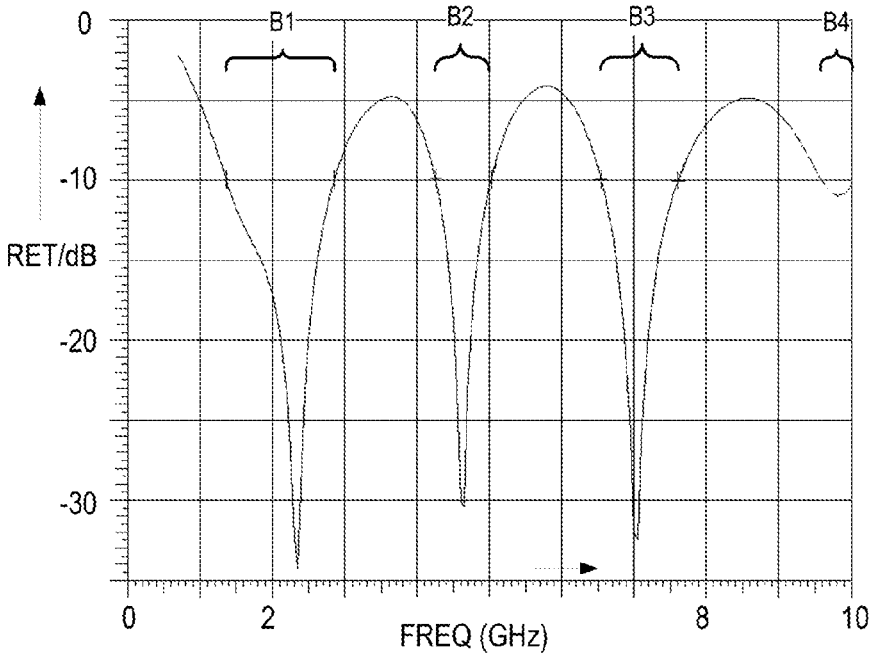
Figure 20:
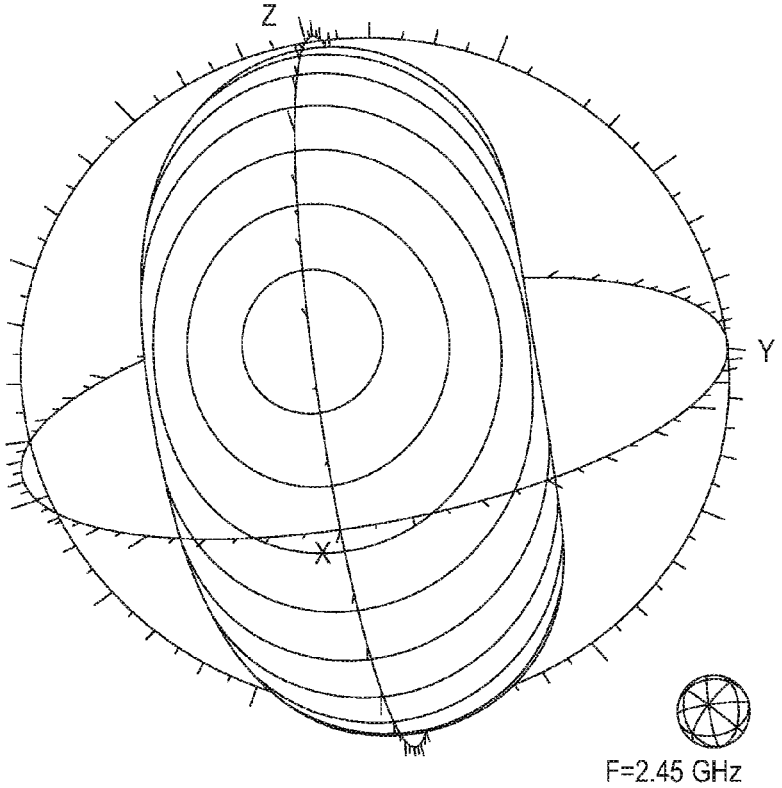

FIG. 20 shows the effect of moving the position of the secondary slot to that shown at 342 in FIG. 6. Near the feed 114, the peripheral portion 110*a* of the active patch is very much complete, yielding a full balanced feed. The bandwidth is in each sub-band is still around 1 GHz, but we have (a) improved performance especially in sub-band B1 and (b) a higher directivity and gain from this variation.

Figure 21:
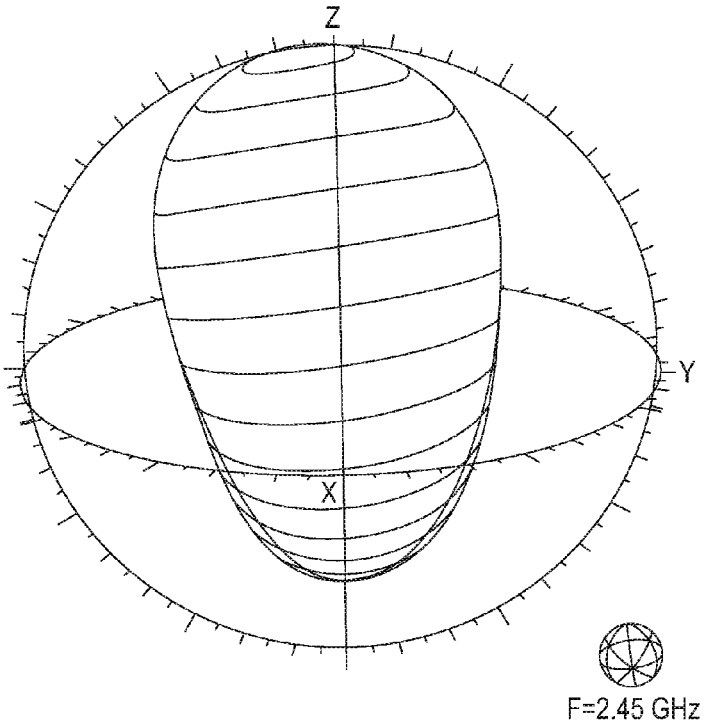
FIGS. 21 and 22 present radiation patterns showing the directivity introduce by a slot in the parasitic ground patch.
Figure 22:
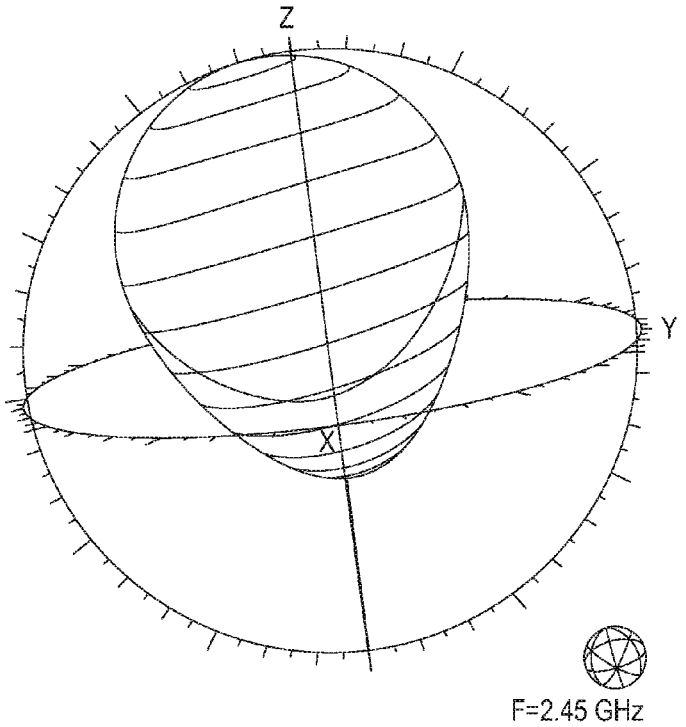

FIGS. 21 and 22 show the change in the radiation pattern (directivity) achievable by introducing the rear slot 132 in the ground patch. The active patch in this example has the same form as the one simulated in FIG. 15. It is found that return loss remains substantially the same, but comparing FIG. 21 or 22 with FIG. 15(*b*) one can see that the directivity increases as a greater part of the radiation is reflected back into the forward normal (Z) direction. By optimising the shape of the slot in a particular geometry, as illustrated in FIGS. 2 and 10 to 13, a desired directional radiation pattern is achieved. In FIG. 21, a large, square slot 132 is provided, which is substantially larger than the spiral slot area on the front side of the substrate and leaves only a narrow peripheral portion of ground conductor under the active patch. In FIG. 22, a more optimised design yields even greater directivity. The slot 132 is again square, but very similar in size to the spiral slot area, for example a 5 mm square.

This improved directivity, which may be for example greater than 3 db or greater than 4 dB at a given operating frequency, allows for diversity. It also enables the antennas to be placed closer together so as to create compact antenna arrays. The antennas by virtue of their lower Q are also less susceptible to interference and mutual coupling. As the slot dimension affects the gain and the Q of the antenna, a balance between a higher directivity and a reasonable gain can be achieved through iterative design of the antenna geometry.

Figure 23:
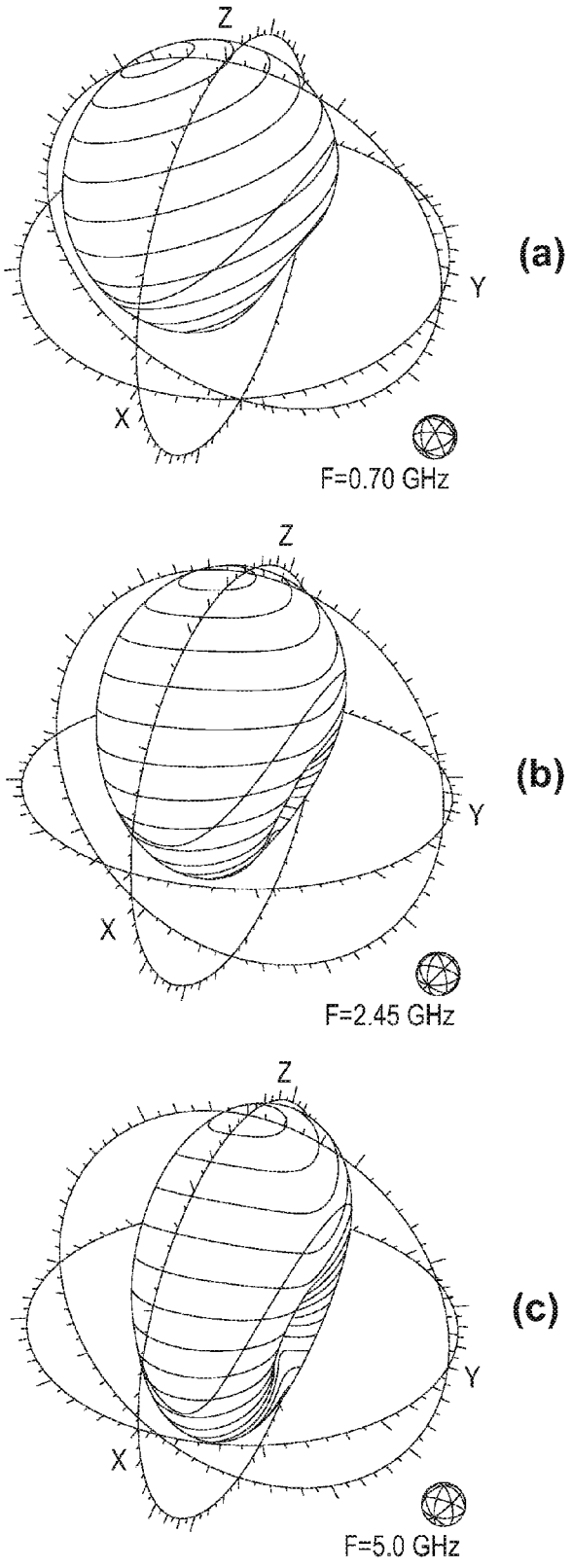
FIGS. 23 and 24 present radiation patterns for two example multi-element antenna devices at three different frequencies.

FIG. 23 shows the radiation pattern for an array of two antenna elements, as might be used for MIMO applications. The antenna elements are arranged end-to-end as in the case of 202-1 and 202-1 in FIG. 3, which gives a higher directivity. The radiation pattern is different at different frequencies, and frequencies measured here are (a) 700 MHz, (b) 2.45 GHz and (c) 5.0 GHz. The beam width narrows (directivity increases) as the frequency goes up. This is due to the inter-element distance being greater in terms of the wavelength, which is shorter at higher frequencies.

Figure 24:
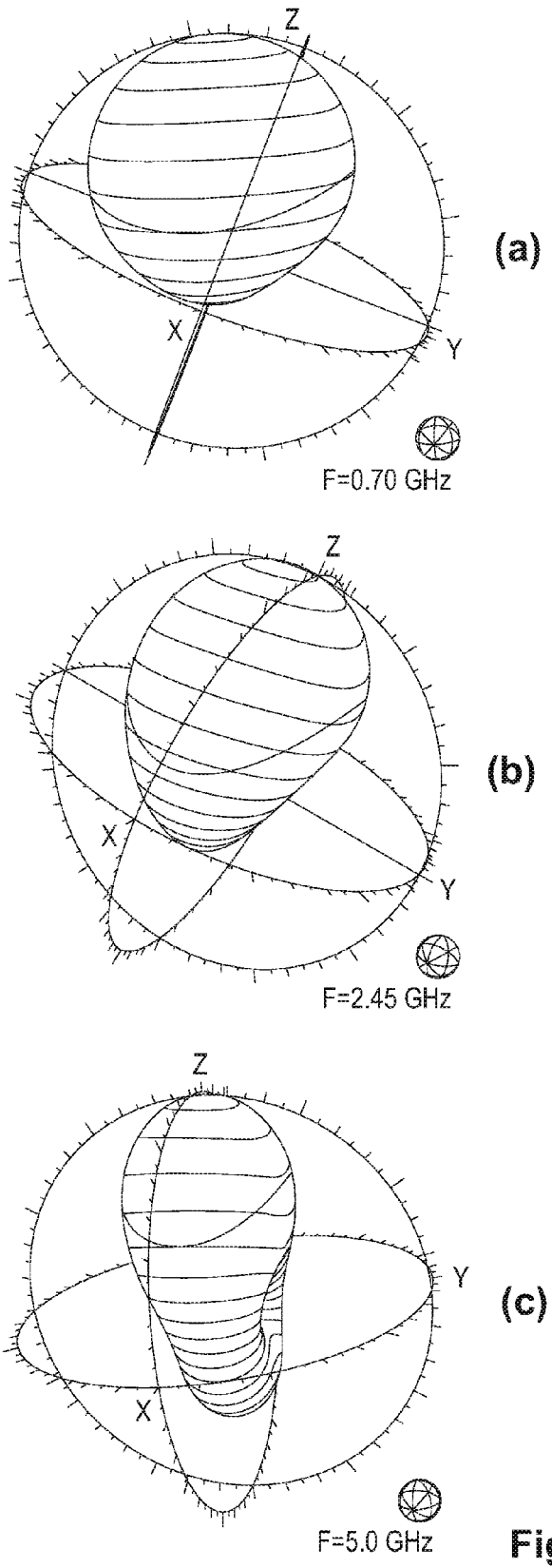

FIG. 24 shows the radiation pattern of a 2×2 array of antenna elements such as that shown in FIG. 3. Again the frequencies shown are (a) 700 MHz, (b) 2.45 GHz and (c) 5.0 GHz. The beam width narrows (directivity increases) as the frequency goes up, as before. This is due to the inter-element distance being greater in terms of the wavelength, which is shorter at higher frequencies.

Figure 25:
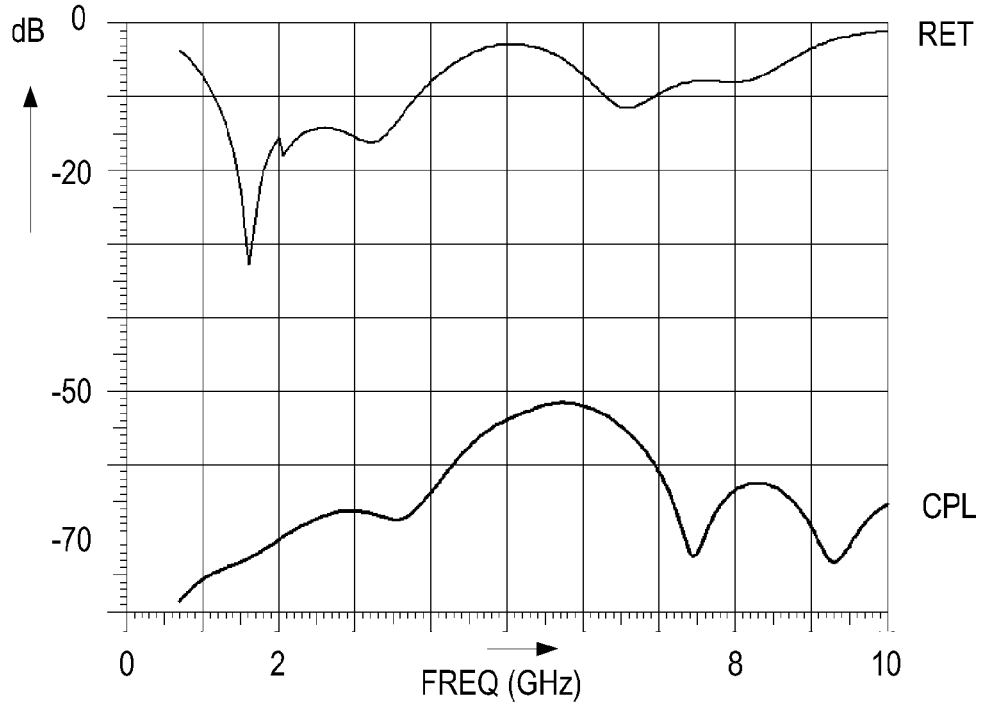
FIGS. 25 and 26 present simulated return loss RET and mutual coupling CPL for a pair of antenna elements at spacing 4 cm and 2 cm respectively.
Figure 26:
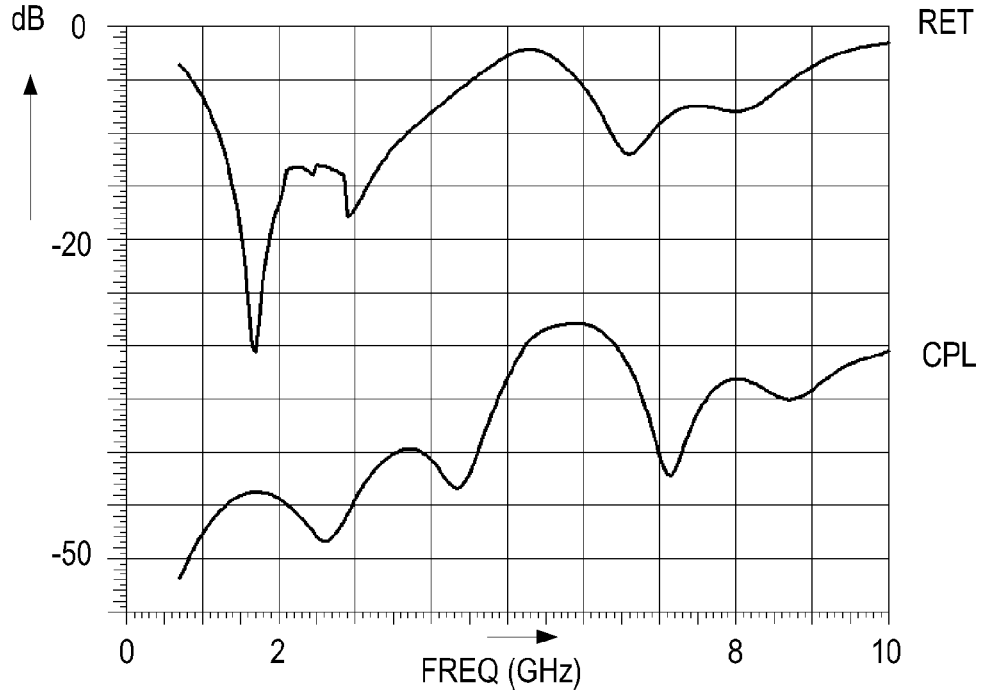

FIGS. 25 & 26 show simulated spectra of return loss RET and mutual coupling CPL between two of the novel antenna elements when in a compact array, and the effect of the gap (D in FIG. 5) between elements. In FIG. 24, D=40 mm and the mutual coupling is less than −50 dB even at its highest point on the spectrum. In FIG. 26 the gap is reduced to 20 mm the coupling is less than −27 dB. Clearly the reduced distance and frequency have increased the coupling between the elements, but this level is still reduced from the what one would normally achieve by the current state-of art antenna.

The spacing D can be expressed in terms of the free space wavelength λ at a given operating frequency. The spacing D can be as little as λ/400 at the lowest designed operating frequency of the antenna array, and as high as λ/2 at the highest operating frequency. As mentioned already, conventional wisdom would be to separate the elements by at least λ/2 at any operating frequency, so as to avoid undue mutual coupling. Acceptable levels of mutual coupling for a MIMO application or other application might be for example −10 dB, −12 dB, −15 dB or even −20 dB in practice. Where an array has more than two elements, the coupling will exist between every pair of elements, but one would expect that it will generally be strongest between the immediate neighbour elements. This is confirmed in simulation and experiment.

Figure 27:
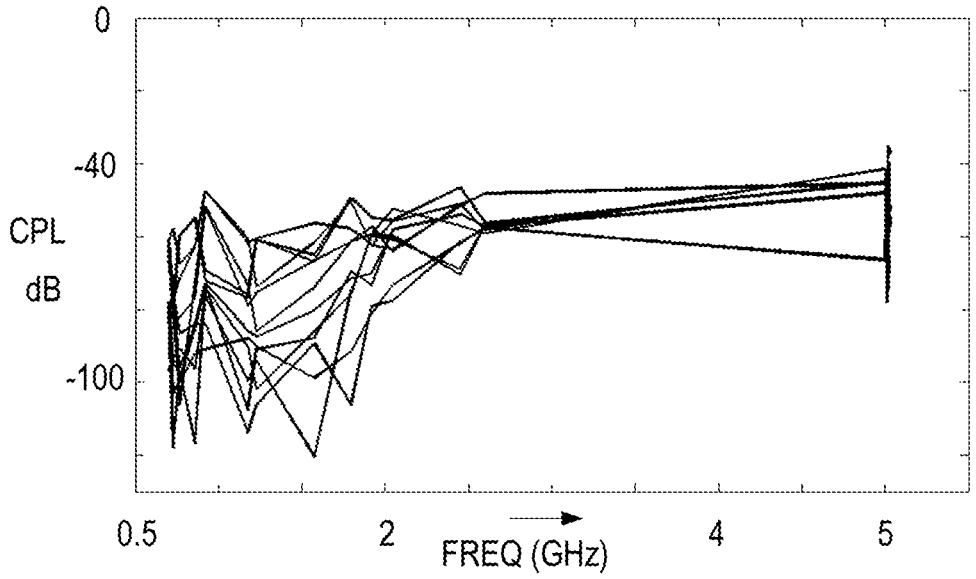
FIGS. 27 and 28 present measured mutual coupling between pairs of elements in four-element antenna devices made according to embodiments of the invention.
Figure 28:
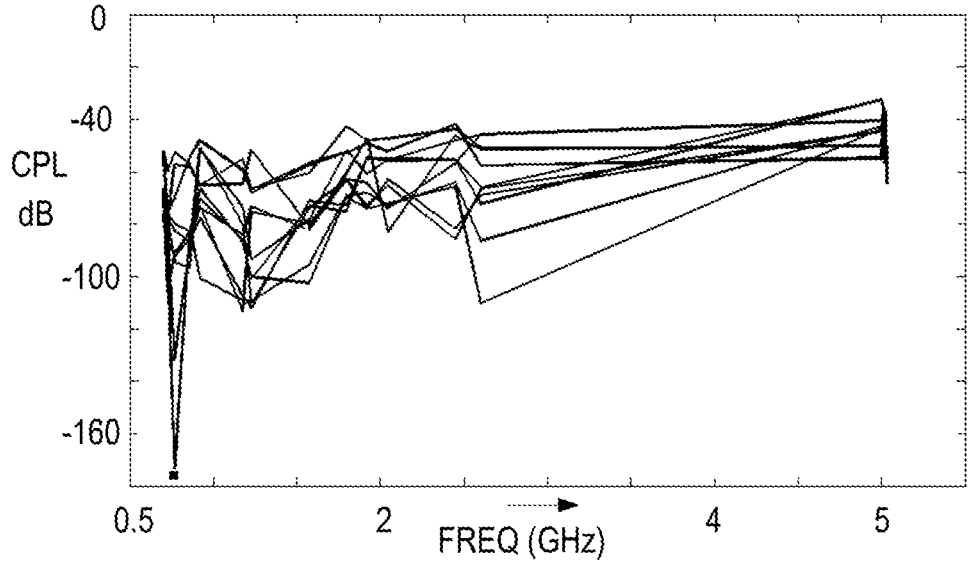

FIGS. 27 and 28 shows the mutual coupling actually measured between pairs of elements in a four-element array such as the one shown in FIG. 4 using the novel element design. In FIG. 27, the spacing D between elements was just 4 mm, with a pitch P around 20 mm. In FIG. 28 the spacing D was increased to 20 mm, with a pitch P around 35 mm. In both cases, the mutual coupling is lower than −40 dB across the entire spectrum from 0.70 GHz to 5 GHz, indicating very suitable characteristics for use in MIMO and/or smart antenna arrays and UWB applications.

Polarisation is another characteristic of the electromagnetic wave generated from the antenna which then travels in air. Most spiral antennas generate circular polarisation. In our designs as covered by the present application it is possible for a suitable choice of geometric configuration to be chosen to yield the particular polarisation required by a particular communication protocol. For example, linear polarisation, particularly a vertical polarisation is the choice in cellular mobile communication systems, where the plane is normal to the substrate.

Having a vast number of variations is ideal as one can customise the characteristics of the antenna depending on the performance sought. Hence for an omnidirectional element a full ground patch/reflector is utilised, whilst for a highly directional element a slotted ground is utilised.

The invention claimed is:

1. An antenna element comprising an active patch formed by a conductive layer on a front surface of a substrate and a ground patch formed by a conductive layer on a back surface of the substrate, wherein:

the active patch comprises an conductive area having at least one spiral slot in a central portion thereof, and having conductive peripheral portions substantially surrounding the central portion, said conductive peripheral portions having a width substantially greater than a trace width (WT) of the spiral slot;

a signal feed strip is formed by a part of said conductive layer extending from a side of said active patch across the front surface of the substrate; and at least one signal ground strip is formed adjacent to the signal feed strip on the front surface of the substrate and extends toward the active patch, but separated therefrom by a predetermined gap, such that the ground patch on the back surface is coupled parasitically to the active patch and said at least one signal ground strip.

2. An antenna element as claimed in claim 1 wherein said ground patch comprises a conductive area having at least one slot in a central portion thereof and a peripheral portion substantially bounding the central portion, and wherein the central portion of the ground patch and the central portion of the active patch are located substantially back-to-back with one another through the substrate.

3. An antenna element as claimed in claim 1 wherein the central portion of the ground patch is provided with one slot in the form of an aperture that is comparable in area with the central portion of the active patch defined by the spiral slot.

4. An antenna element as claimed in claim 3 wherein the shape of the main slot in the ground patch is such that in one or more first directions it extends beyond the central area of the active patch, and in one or more second directions it stops short of the central area of the active patch.

5. An antenna element as claimed in claim 1 wherein the parasitic ground patch extends beneath the signal feed strip and said at least one signal ground strip.

6. An antenna element as claimed in claim 1 wherein the active patch includes additional conductive material in the vicinity of said gaps.

7. An antenna element as claimed in claim 1 wherein two signal ground strips are provided on said front surface, extending generally parallel to the signal feed strip and spaced to either side thereof and each separated from the active patch by a predetermined gap.

8. An antenna element as claimed in claim 7 wherein the active patch includes additional conductive material in the vicinity of one or both of said gaps.

9. An antenna element as claimed in claim 1 wherein at least one small extension of the conductive area extends part way across the gap between the active patch and said at least one signal ground strip.

10. An antenna element as claimed in claim 1 wherein continuity in the peripheral portion of the active patch is partially or completely interrupted by a further slot portion extending outward from the spiral slot.

11. An antenna element as claimed in claim 1 wherein the width of at least one part of said peripheral portion of the active patch is reduced by an additional slot portion.

12. An antenna device comprising a plurality of antenna elements each of the form claimed in claim 1.

13. An antenna device as claimed in claim 12 wherein said antenna elements are formed on a common substrate.

14. An antenna device as claimed in claim 12 wherein the peripheral portion of the ground patch of one of said antenna elements is contiguous with that or another of said elements.

15. An antenna device as claimed in claim 12 wherein said antenna elements include a first and second antenna element, wherein said first and second antenna element are spaced from one another in a direction, and wherein a spacing in said direction between the active patch of said first element and that of a second element is less than twice the dimension of the active patch of the first element.

16. An antenna device as claimed in claim 12 wherein said antenna elements include a first and second antenna element, wherein said first and second antenna element are spaced from one another in a direction, and wherein a spacing in said direction between the active patch of said first element and that of said second element is less than or equal to half the wavelength of the active patch of the first element.

17. An antenna device comprising a plurality of antenna elements including a first and second antenna element, each antenna element comprising an active patch formed by a conductive layer on a front surface of a substrate and a ground patch formed by a conductive layer on a back surface of the substrate, wherein for each antenna element:

said active patch comprises a conductive area having at least one spiral slot in a central portion thereof and having conductive peripheral portions substantially surrounding the central portion, said conductive peripheral portions having a width substantially greater than a trace width (WT) of the spiral slot;

a signal feed strip is formed by a part of said conductive layer extending from a side of said active patch across the front surface of the substrate; and at least one signal ground strip is formed adjacent to the signal feed strip on the front surface of the substrate and extends toward the active patch, but separated therefrom by a predetermined gap, such that the ground patch on the back surface is coupled parasitically to the active patch and said at least one signal ground strip; and wherein said first and second antenna element are spaced from one another in a direction, and wherein a spacing in said direction between the active patch of said first element and that of said second element is less than or equal to half the wavelength of the active patch of the first element.

* * * * *